US007991331B2

(12) United States Patent
Uematsu

(10) Patent No.: US 7,991,331 B2
(45) Date of Patent: Aug. 2, 2011

(54) DEVELOPING UNIT, VISUALIZED IMAGE FORMATION UNIT AND IMAGE FORMING APPARATUS

(75) Inventor: Ryosuke Uematsu, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 579 days.

(21) Appl. No.: 12/076,497

(22) Filed: Mar. 19, 2008

(65) Prior Publication Data

US 2008/0232858 A1 Sep. 25, 2008

(30) Foreign Application Priority Data

Mar. 22, 2007 (JP) ..... 2007-075512
Feb. 1, 2008 (JP) ..... 2008-022695

(51) Int. Cl.
*G03G 15/08* (2006.01)

(52) U.S. Cl. ..... 399/255; 399/254; 399/256

(58) Field of Classification Search ..... 399/254, 399/255, 256, 258, 260
See application file for complete search history.

(56) References Cited

U.S. PATENT DOCUMENTS 7,627,272 B2 * 12/2009 Iwamura ..... 399/254
7,783,215 B2 * 8/2010 Tanaka ..... 399/62
2002/0176717 A1 * 11/2002 Bray et al. ..... 399/49
2006/0018673 A1 * 1/2006 Choi ..... 399/27
2006/0222412 A1 * 10/2006 Ito et al. ..... 399/258
2006/0263106 A1 * 11/2006 Yamaguchi et al. ..... 399/27
2007/0280739 A1 * 12/2007 Tanaka ..... 399/254

FOREIGN PATENT DOCUMENTS

JP A-11-160989 6/1999
JP A-2006-171177 6/2006

OTHER PUBLICATIONS

Machine translation provided by Applicant of Kikuchi (Pub No. JP 2006-171177) pub date Jun. 29, 2006.*

* cited by examiner

*Primary Examiner* — David M Gray
*Assistant Examiner* — Rodney Bonnette
(74) *Attorney, Agent, or Firm* — Oliff & Berridge, PLC

(57) ABSTRACT

A developing unit includes a developer consumption calculator calculating consumptions of developer in zones and storing the consumption in each zone into a corresponding storage region; a consumption shift unit shifting the consumption stored in the storage region corresponding to each zone to a storage region corresponding to a zone located on a downstream side in a developer conveyance direction in response to the conveying of the developer by the circulation conveyance member; a supply amount setting unit setting a supply amount from a developer supply portion based on the consumption stored in the storage region corresponding to the zone corresponding to the developer supply position; and a developer supply controller controlling supply of the developer from the developer supply portion based on the set supply amount.

13 Claims, 23 Drawing Sheets

(FIG. 5 CONTINUED)
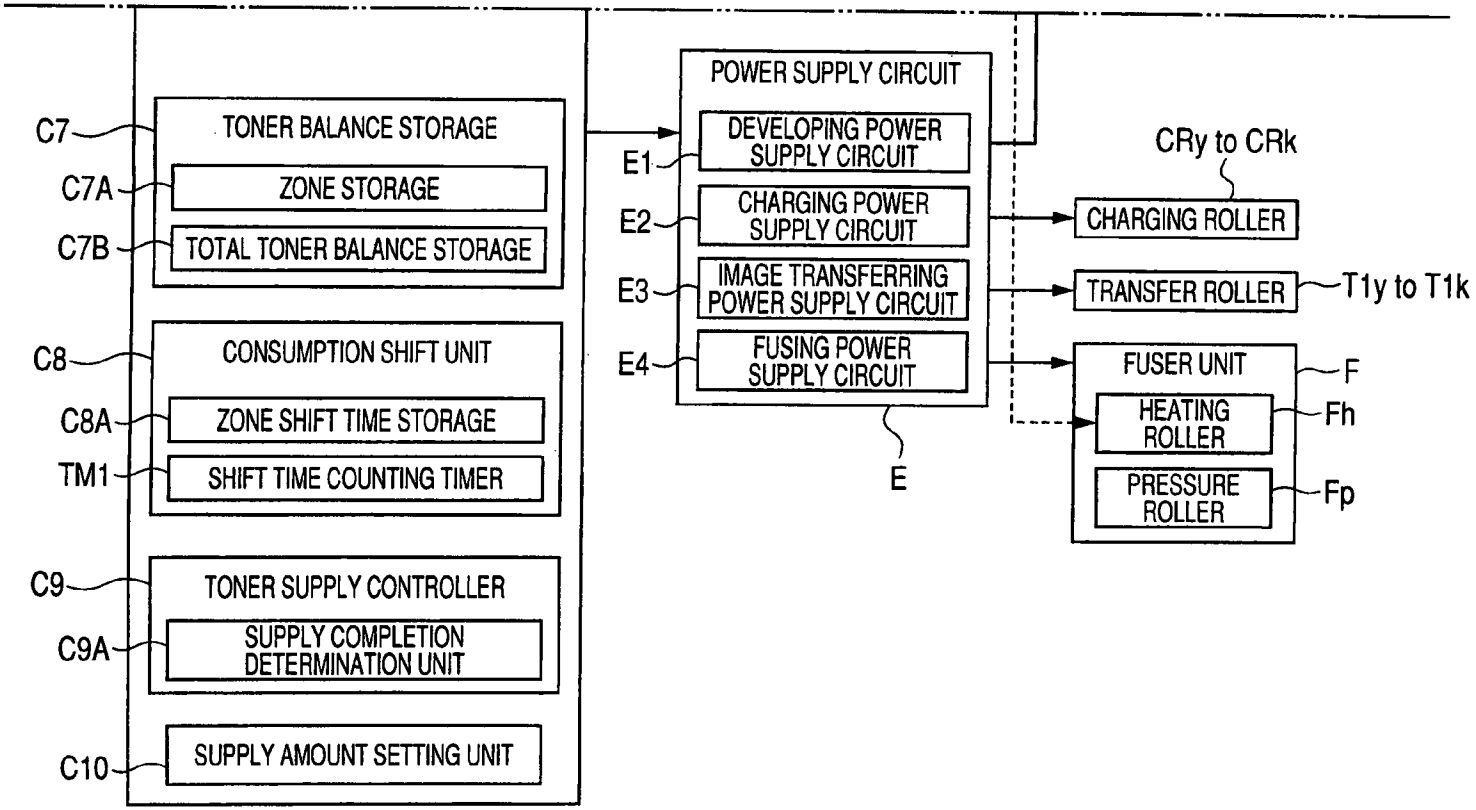

CONSUMPTION SHIFT PROCESS (CONT. FIG. 10-2)

(FIG. 10-2 CONTINUED)

| | | | | | |
|---|---|---|---|---|---|
| 4 | AFTER TONER CONSUMPTION IS ADDED<br>DEFINITE VALUE AFTER SHIFTING | 0 0 0 0 1 2 3 4 4 4 3 2 1 0 0<br>0 0 0 1 2 3 4 4 4 3 2 1 0 0 0 | 0 0 1 1 1 1 1 1 0 0 | 6 | 0 | -24 |
| 5 | DEFINITE VALUE AFTER SHIFTING | 0 0 1 2 3 4 5 5 4 3 2 1 0 0 0 | 0 0 1 1 1 1 1 1 0 0 | 6 | 0 | -30 |
| 6 | DEFINITE VALUE AFTER SHIFTING | 0 1 2 3 4 5 6 5 4 3 2 1 0 0 0 | 0 0 1 1 1 1 1 1 0 0 | 6 | 0 | -36 |
| 7 | DEFINITE VALUE AFTER SHIFTING | 1 2 3 4 5 6 6 5 4 3 2 1 0 0 0 | 0 0 1 1 1 1 1 1 0 0 | 6 | 1 | -42 |
| 8 | DEFINITE VALUE AFTER SHIFTING | 2 3 4 5 6 6 6 5 4 3 2 1 0 0 0 | 0 0 1 1 1 1 1 1 0 0 | 6 | 2 | -47 |
| 9 | DEFINITE VALUE AFTER SHIFTING | 3 4 5 6 6 6 6 5 4 3 2 1 0 0 0 | 0 0 1 1 1 1 1 1 0 0 | 6 | 3 | -51 |
| 10 | DEFINITE VALUE AFTER SHIFTING | 4 5 6 6 6 6 6 5 4 3 2 1 0 0 0 | 0 0 1 1 1 1 1 1 0 0 | 6 | 4 | -54 |
| 11 | DEFINITE VALUE AFTER SHIFTING | 5 6 6 6 6 6 5 4 3 2 1 0 0 0 | 0 0 1 1 1 1 1 1 0 0 | 6 | 5 | -56 |

(CONT. FIG. 10-3)

(FIG. 10-3 CONTINUED)

| | | | | | |
|---|---|---|---|---|---|
| 12 | DEFINITE VALUE AFTER SHIFTING | 6 6 6 6 6 6 6 5 4 3 2 1 0 0 0 | 0 0 1 1 1 1 1 1 0 0 | 6 | 6 -57 |
| 13 | DEFINITE VALUE AFTER SHIFTING | 6 6 6 6 6 6 6 5 4 3 2 1 0 0 0 | 0 0 1 1 1 1 1 1 0 0 | 6 | 6 -57 |
| 14 | DEFINITE VALUE AFTER SHIFTING | 6 6 6 6 6 6 6 5 4 3 2 1 0 0 0 | 0 0 1 1 1 1 1 1 0 0 | 6 | 6 -57 |
| 15 | DEFINITE VALUE AFTER SHIFTING | 6 6 6 6 6 6 6 5 4 3 2 1 0 0 0 | 0 0 1 1 1 1 1 1 0 0 | 6 | 6 -57 |
| 16 | DEFINITE VALUE AFTER SHIFTING | 6 6 6 6 6 6 5 4 3 2 1 0 0 0 0 | 0 0 0 0 0 0 0 0 0 0 | 0 | 6 -51 |
| 17 | DEFINITE VALUE AFTER SHIFTING | 6 6 6 6 6 5 4 3 2 1 0 0 0 0 0 | 0 0 0 0 0 0 0 0 0 0 | 0 | 6 -45 |
| 18 | DEFINITE VALUE AFTER SHIFTING | 6 6 6 6 5 4 3 2 1 0 0 0 0 0 0 | 0 0 0 0 0 0 0 0 0 0 | 0 | 6 -39 |
| 19 | DEFINITE VALUE AFTER SHIFTING | 6 6 6 5 4 3 2 1 0 0 0 0 0 0 0 | 0 0 0 0 0 0 0 0 0 0 | 0 | 6 -33 |
| 20 | DEFINITE VALUE AFTER SHIFTING | 6 6 5 4 3 2 1 0 0 0 0 0 0 0 0 | 0 0 0 0 0 0 0 0 0 0 | 0 | 6 -27 |

(CONT. FIG. 10-4)

(FIG. 10-4 CONTINUED)

| | | | | | |
|---|---|---|---|---|---|
| 21 | DEFINITE VALUE AFTER SHIFTING | 6 5 4 3 2 1 0 0 0 0 0 0 0 0 0 | 0 0 0 0 0 0 0 0 0 0 | 0 | 6 | -21 |
| 22 | DEFINITE VALUE AFTER SHIFTING | 5 4 3 2 1 0 0 0 0 0 0 0 0 0 0 | 0 0 0 0 0 0 0 0 0 0 | 0 | 5 | -15 |
| 23 | DEFINITE VALUE AFTER SHIFTING | 4 3 2 1 0 0 0 0 0 0 0 0 0 0 0 | 0 0 0 0 0 0 0 0 0 0 | 0 | 4 | -10 |
| 24 | DEFINITE VALUE AFTER SHIFTING | 3 2 1 0 0 0 0 0 0 0 0 0 0 0 0 | 0 0 0 0 0 0 0 0 0 0 | 0 | 3 | -6 |
| 25 | DEFINITE VALUE AFTER SHIFTING | 2 1 0 0 0 0 0 0 0 0 0 0 0 0 0 | 0 0 0 0 0 0 0 0 0 0 | 0 | 2 | -3 |
| 26 | DEFINITE VALUE AFTER SHIFTING | 1 0 0 0 0 0 0 0 0 0 0 0 0 0 0 | 0 0 0 0 0 0 0 0 0 0 | 0 | 1 | -1 |
| 27 | DEFINITE VALUE AFTER SHIFTING | 0 0 0 0 0 0 0 0 0 0 0 0 0 0 0 | 0 0 0 0 0 0 0 0 0 0 | 0 | 0 | 0 |

(FIG. 11 CONTINUED)
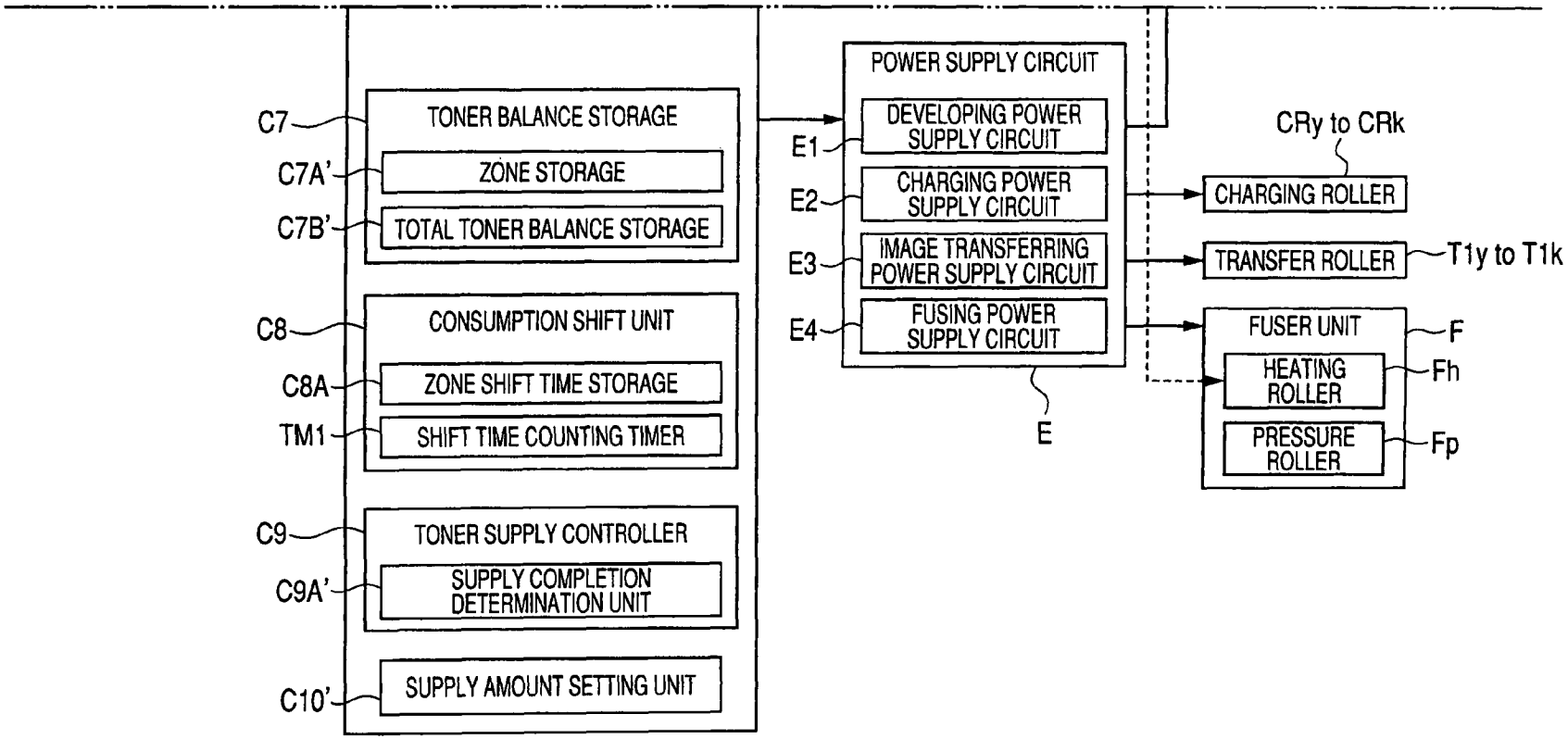

TONER CONSUMPTION, SUPPLY, BALANCE

TOTAL DENSITY TRANSITION

TONER CONSUMPTION, SUPPLY, BALANCE

TOTAL DENSITY TRANSITION

TONER CONSUMPTION, SUPPLY, BALANCE

TOTAL DENSITY TRANSITION

TONER CONSUMPTION, SUPPLY, BALANCE

TOTAL DENSITY TRANSITION

DEVELOPING UNIT, VISUALIZED IMAGE FORMATION UNIT AND IMAGE FORMING APPARATUS

CROSS-REFERENCE TO RELATED APPLICATIONS

This application is based on and claims priority under 35 U.S.C. §119 from Japanese Patent-Application Nos. 2007-75512 (filed Mar. 22, 2007) and 2008-22695 (filed Feb. 1, 2008).

BACKGROUND

1. Technical Field

The invention relates to a developing unit, a visualized image formation unit and an image forming apparatus.

2. Related Art

In an image forming apparatus such a copying machine and a printer which utilize an electrophotography system, a developing unit is disposed in such a manner as to face an image carrying body in which a latent image is formed on a surface thereof. The latent image is visualized with a developer supplied from the developing unit to form an image. When the developer is consumed as a result of forming the image in that way, a developer is supplied to the developing unit.

SUMMARY

According to an aspect of the invention, a developing unit includes a developer carrying body, a circulation conveyance chamber, a circulation conveyance member, a developer supply portion, a developer consumption calculator, a consumption shift unit, a supply amount setting unit and a developer supply controller. The developer carrying body is accommodated in a developer-carrying-body accommodation chamber. The developer carrying body holds a developer on a surface thereof to convey the developer to a developing zone where a latent image is developed into a visualized image. The circulation conveyance chamber includes a first agitating conveyance chamber and a second agitating conveyance chamber. The first agitating conveyance chamber is disposed to be adjacent to the developer-carrying-body accommodation chamber. The first agitating conveyance chamber accommodates therein a two-component developer. The second agitating conveyance chamber is disposed to be adjacent to the first agitating conveyance chamber. The second agitating conveyance chamber includes an inlet portion and an outlet portion. The developer flows in through the inlet port from the first agitating conveyance chamber. The developer flows out through the outlet port to the first agitating conveyance chamber. In the circulation conveyance chamber, the developer is conveyed in a circulating fashion. The circulation conveyance member includes a first developer conveyance member and a second developer conveyance member. The first developer conveyance member is accommodated in the first agitating conveyance chamber. The first developer conveyance member conveys the developer in the first agitating conveyance chamber in a first conveyance direction. The second developer conveyance member is accommodated in the second agitating conveyance chamber. The second developer conveyance member conveys the developer in the second agitating conveyance chamber in a second conveyance direction opposite to the first conveyance direction. The circulation conveyance member conveys the developer in the circulation conveyance chamber in a circulating fashion. The developer supply portion is provided in a developer supply position of the circulation conveyance chamber. The developer consumption calculator calculates consumptions of developer in zones. At least a part of the circulation conveyance chamber is divided into the plurality of zones each having a predetermined range along the first conveyance direction and the second conveyance direction. The consumption shift unit shifts the consumption in each zone to a zone located on a downstream side of each zone in the developer conveyance direction in response to the conveying of the developer by the circulation conveyance member. The supply amount setting unit sets a supply amount from the developer supply portion based on the consumption in the zone corresponding to the developer supply position. The developer supply controller controls supply of the developer from the developer supply portion based on the set supply amount.

BRIEF DESCRIPTION OF THE DRAWINGS

Exemplary embodiments of the invention will be described in detail below with reference to the accompanying drawings, wherein:

FIG. 3 shows explanatory drawings of a visualized image formation unit, which is an example of a detachable unit of the exemplary embodiment 1.

FIG. 6 shows explanatory drawings of accumulated consumption calculation zones of the exemplary embodiment 1.

FIG. 14 shows graphs showing experiment results of an experiment 1.

FIG. 15 shows graphs showing experiment results of a comparison example 1.

FIG. 16 shows graphs showing experiment results of an experiment 2.

FIG. 17 shows graphs showing experiment results of a comparison example 2, FIG. 18 is an explanatory drawing of a modified example.

DETAILED DESCRIPTION

Figure 1:
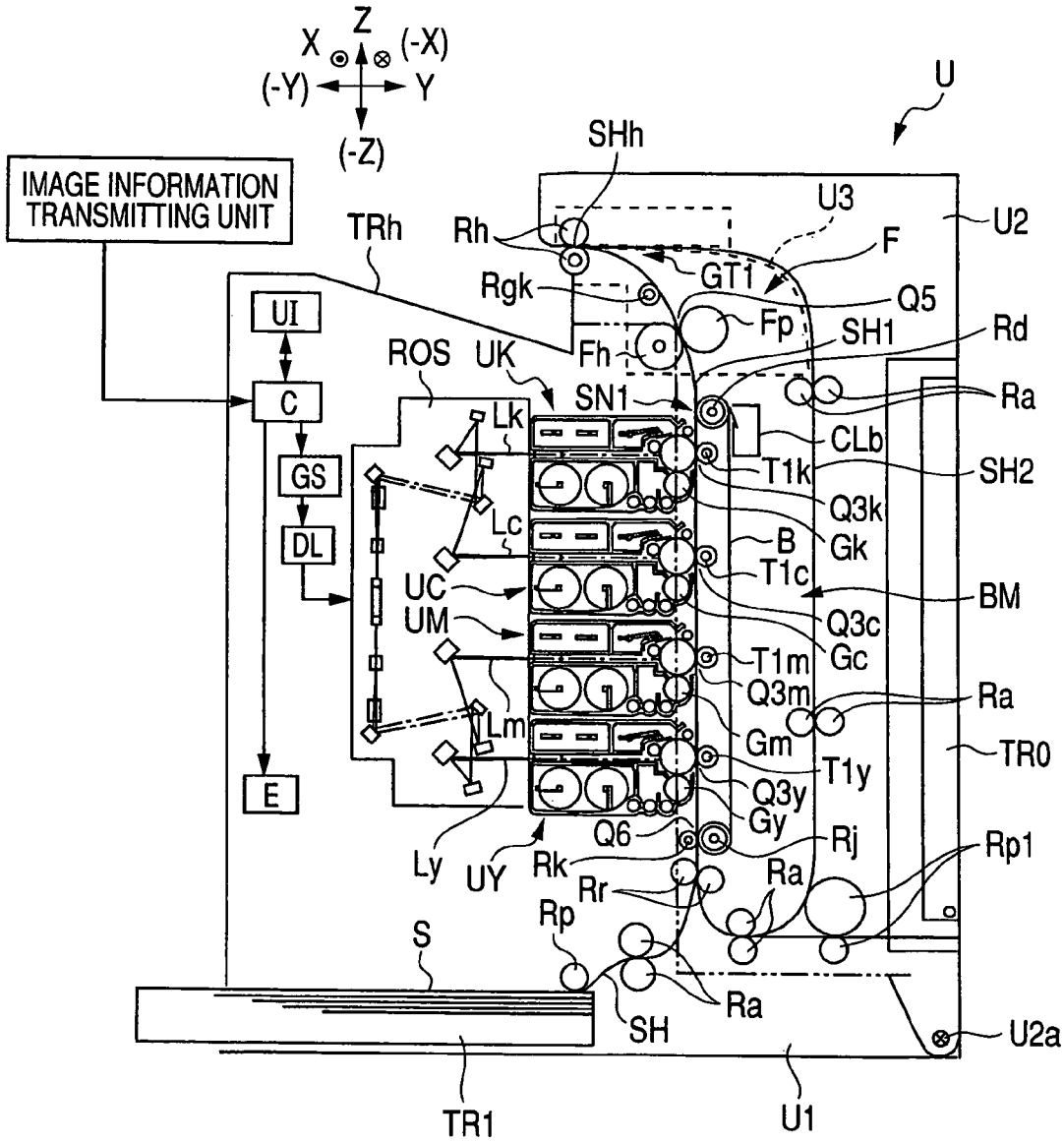
FIG. 1 is an overall explanatory drawing of an image forming apparatus according to an exemplary embodiment 1 of the invention.

Next, referring to the drawings, specific examples (hereinafter, referred to as exemplary embodiments) of the invention will be described. However, it should be noted that the invention is not limited to the exemplary embodiments which will be described below.

For easy understanding of the descriptions that will be made below, in the drawings, an anteroposterior direction will be represented by an X axis direction, a right and left direction by a Y axis direction, and an up and down direction by a Z axis direction, and directions or sides denoted by X, −X, Y, −Y, Z and −Z will be understood, respectively, as frontward, rearward, rightward, leftward, upward and downward directions, or front side, rear side, right-hand side, left side, upper side and lower side.

In addition, in the drawings, a circle with a dot shown therein means an arrow which is directed from a back to a front of a sheet of paper on which a drawing is drawn, and a circle with a cross shown therein means an arrow which is directed from a front to a back of a sheet of paper on which a drawing is drawn.

In descriptions that will be made below with reference to the drawings, in order to facilitate the understanding of what is illustrated in the drawings, the illustration of a member or members other than those necessary for description will be omitted as required.

Exemplary Embodiment 1

FIG. 1 is an overall explanatory drawing of an image forming apparatus of an exemplary embodiment 1 of the invention.

Figure 2:
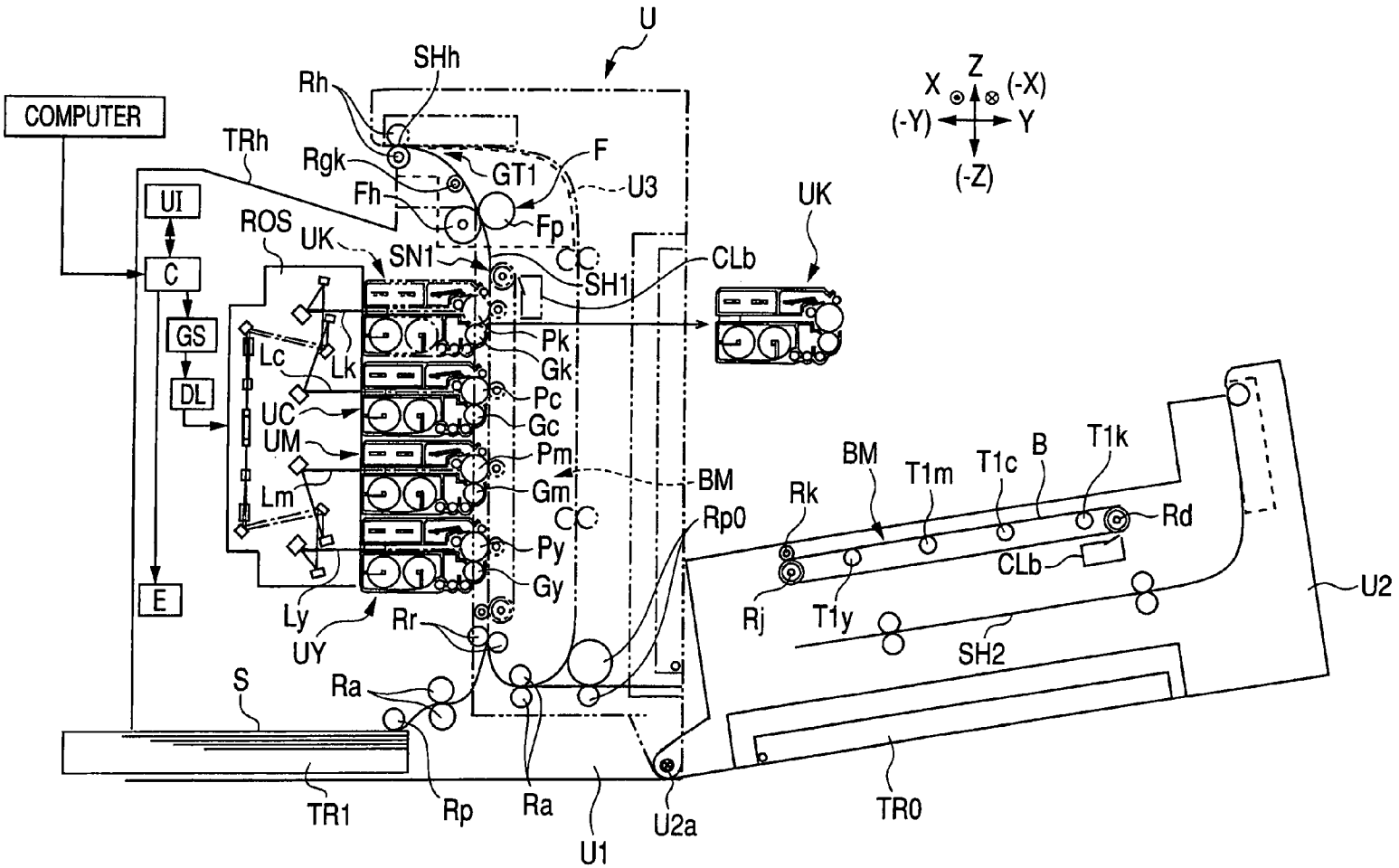
FIG. 2 is an explanatory drawing of the image forming apparatus of the exemplary embodiment 1 of the invention with an opening/closing portion left opened.

FIG. 2 is an explanatory drawing of the image forming apparatus of the exemplary embodiment 1 of the invention with an opening/closing portion thereof left opened.

In FIG. 1, a printer U as an example of an image forming apparatus of the exemplary embodiment 1 of the invention has: a sheet feeding tray TR1 which is accommodated in a lower portion for storing recording media S as an example of a recording medium on which an image is to be recorded; and a sheet discharging tray TRh which is provided on an upper surface thereof. In addition, an operation section UI is provided in an upper portion of the printer U.

In FIGS. 1, 2, the printer U of the exemplary embodiment 1 has an image forming apparatus main body U1 and an opening/closing portion U2 which is configured to be opened and closed about a rotational center U2*a* which is provided in an end portion of a bottom right side of the image forming apparatus main body U1. The opening/closing portion U2 is configured so as to be movable between an open position (see solid lines in FIG. 2) where an interior of the image forming apparatus main body 1 is open to be accessible for refill of a developer, replacement of a failed member or removal of a jammed recording medium S and a closed position (see chain double-dashed lines in FIGS. 1 and 2) where the opening/closing portion is held at a normal time at which an image formation operation is executed.

The printer U has a control section C for performing various controls of the printer U, an image processing section GS whose operation is controlled by the control section C, an image writing unit driving circuit DL, a power supply unit E and the like. The power supply unit E applies a voltage to charging rollers CRy to CRk each of which constitutes an example of a charger described later, developing rollers G1*y* to G1*k* each of which constitutes an example of a developer carrying body, image transfer rollers T1*y* to T1*k* each of which constitutes an image transfer device, and the like.

The image processing section GS converts printing information which is input from an external image information transmitting unit into image information for latent image formation which corresponds to images of four colors of K (black), Y (yellow), M (magenta) and C (cyan) and outputs the resultant image information to the image writing unit driving circuit DL at predetermined timings. The image writing unit driving circuit DL outputs drive signals which correspond to the input image information of the respective colors to a latent image writing unit ROS. The latent image writing unit ROS emits laser beams Ly, Lm, Lc, Lk, constituting an example of image writing beams of the respective colors for image writing according the drive signals received.

In FIG. 1, visualized image formation units UY, UM, UC, UK for forming toner images, which constitute examples of visualized images of the respective colors of Y (yellow), M (magenta), C (cyan), K (black), are disposed rightwards (in the +Y direction) of the latent image writing unit ROS.

Figure 3A:
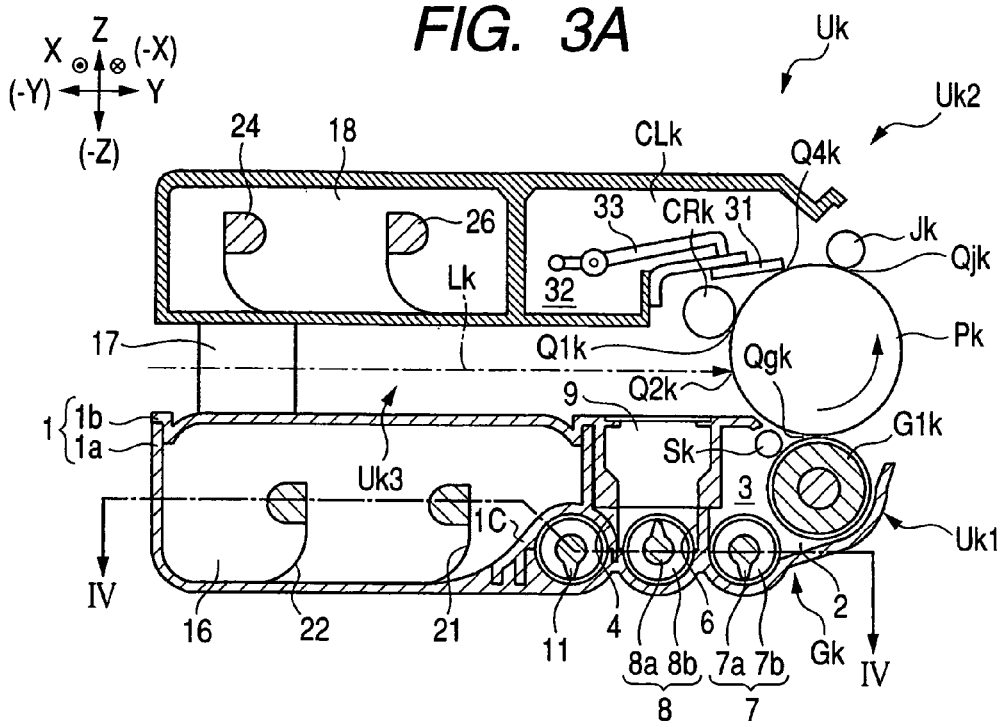
FIG. 3A is an explanatory drawing showing a state where the visualized image formation unit is in use and FIG. 3B is an explanatory drawing showing a state before an initial developer accommodating chamber is opened.
Figure 3B:
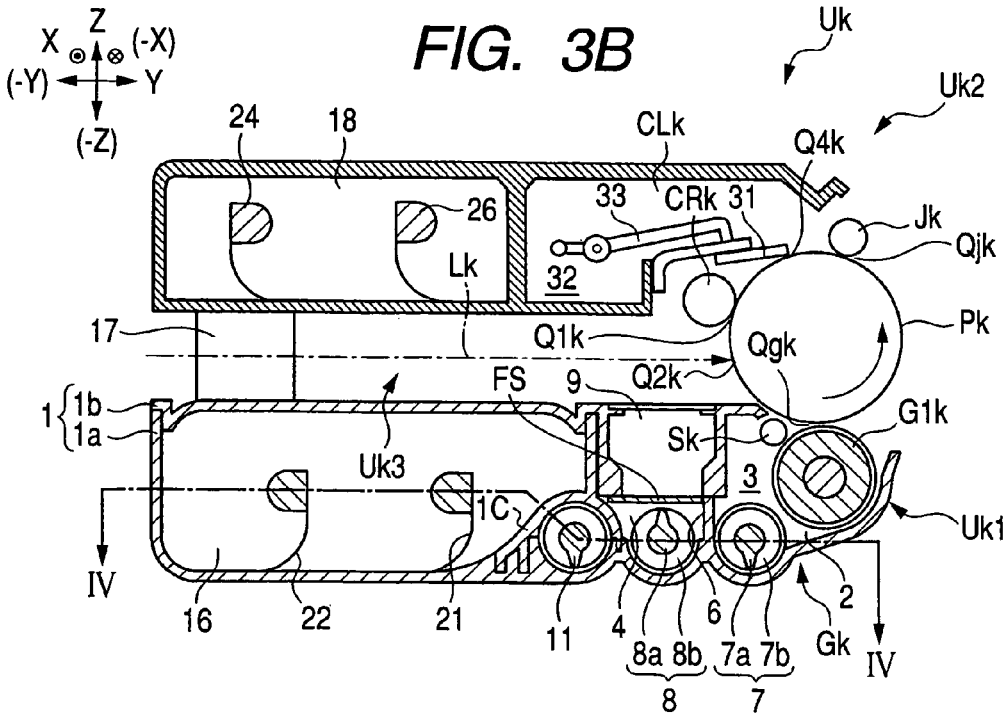

FIG. 3 shows explanatory drawings of the visualized image formation unit which is an example of a detachable unit of the exemplary embodiment 1. FIG. 3A is an explanatory drawing showing a state where the visualized image formation unit is in use and FIG. 3B is an explanatory drawing showing a state before an initial developer accommodating chamber 9 is opened.

In FIG. 3, the visualized image formation unit UK for K (black) has a photoreceptor Pk, which constitutes an example of the rotating image carrying body. Disposed on the periphery of the photoreceptor Pk are the charging roller CRk, which constitutes the example of the charger, a developing unit Gk for developing an electrostatic latent image on a surface of the photoreceptor Pk into a visualized image, a charge eliminating member Jk for eliminating charges on the surface of the photoreceptor Pk, a photoreceptor cleaner CLk, which constitutes an example of an image-carrying-body cleaner for removing residual developer on the surface of the photoreceptor Pk, and the like.

After the surface of the photoreceptor Pk is uniformly charged by the charging roller CRk in a charging zone Q1*k* which faces the charging roller CRk, a latent image is written into the photoreceptor Pk in a latent image formation zone Q2*k* by the laser beam Lk. The electrostatic latent image is developed into a visualized image in a developing zone Qgk which faces the developing unit Uk.

The visualized image formation unit UK for black of the exemplary embodiment 1 is made up of a detachable element into which the photoreceptor Pk, the charger CRk, the charge eliminating member Jk, the photoreceptor cleaner CKk, a developer supply container (11+16+18) and the like are integrated, that is, a so-called process cartridge UK. The visualized image formation unit Uk is configured so as to be detachable from the image forming apparatus main body U1 with the opening/closing portion U2 shifted to the open position, as shown in FIG. 2.

The visualized image formation units UY, UM, UC for the other colors are configured in the same way as the visualized image formation unit UK for black and are made up of detachable elements which are adapted to be detached from the image forming apparatus main body U1, that is, so-called process cartridges UY, UM, UC.

In FIGS. 1 and 2, a belt module BM, which constitutes an example of a recording medium transfer unit, is supported by the opening/closing portion U2 on the right side of the photoreceptors Py to Pk. The belt module BM has: a medium conveyance belt B, which constitutes an example of a recording medium holding/conveying member; belt supporting rollers (Rd+Rj), which constitute an example of a holding/conveying-member support system and which includes a belt driving roller Rd constituting an example of a driving member supporting the medium conveyance belt B and a follower roller Rj constituting an example of a follower member; the transfer rollers T1*y*, T1*m*, T1*c*, T1*k*, as the example of the image transfer devices, which are disposed to face the photoreceptors Py to Pk, respectively; an image density sensor SN1, which constitutes an example of a image density detecting member; a belt cleaner CLb, which constitutes an example of a holding/conveying-member cleaner; and a medium attracting roller Rk, as an example of a recording medium attracting member, which is disposed to face the follower roller Rj and which causes a recoding medium S to be attracted to the medium conveyance belt B. The medium conveyance belt B is supported rotatably by the belt supporting rollers (Rd+Rj). In addition, the image density sensor SN1 detects, at a predetermined timing, a density of an image for density detection, that is, a so-called patch image which is formed by an image density adjusting device (not shown) of the control section C. The image density adjusting device is configured to adjust or correct the image density, that is, perform a so-called process control by adjusting voltages applied to the chargers CRy to Crk, the developing units Gy to Gk and the image transfer rollers T1*y* to T1*k* or adjusting the intensities of the latent image writing beams Ly to Lk.

A recording medium S in the sheet feeder tray TR1 disposed below the medium conveyance belt B is taken out by a sheet feeding member Rp to be conveyed to a recording medium transfer path SH.

The recording medium S in the recording medium transfer path SH is then conveyed by medium transfer rollers Ra, which constitute examples of recording medium transfer members, and transported to registration rollers Rr, which constitute examples of sheet feeding timing adjusting members. The registration rollers Rr convey the recording medium S to a recording medium attracting position Q6 which constitutes a facing zone where the follower roller Rj and the medium attracting roller Rk face each other. The recording medium S conveyed to the recording medium attracting position Q6 is then electrostatically attracted to the medium conveyance belt B.

When a recording medium S is fed from a manual sheet feeding tray TR0, the recording medium S fed by a manual feeding member Rp1 is then conveyed to the registration rollers Rr by medium transfer rollers Ra and transported to the medium conveyance belt B.

The recording medium S, which has been attracted to the medium conveyance belt B, then sequentially passes through the image transfer zones Q3*y*, Q3*m*, Q3*c*, Q3*k* where the recording medium S is brought into contact with the photoreceptors Py to Pk.

In the image transfer zones Q3*y*, Q3*m*, Q3*c*, Q3*k*, an image transfer voltage, which has an opposite polarity to a polarity with which toner is charged, is applied at a predetermined timing to the image transfer rollers T1*y*, T1*m*, T1*c*, T1*k* which are disposed on a back side of the medium conveyance belt B from the power supply circuit E controlled by the control section C.

In the case of a multi-color image, toner images on the respective photoreceptors Py to Pk are transferred on to the recording medium S on the medium conveyance belt B in an overlapped fashion by the image transfer rollers T1*y*, T1*m*, T1*c*, T1*k*. In addition, in the case of a single-color image, that is, a so-called monochrome image, only a toner image of K (black) is formed on the photoreceptor Pk, and only the toner image of K (black) is transferred on to the recording medium S by the image transfer device T1*k*.

Charges on the photoreceptors Py to Pk, from which the toner images have been transferred, are removed by the charge eliminating members Jy to Jk in charge eliminating zones Qjy to Qjk. Thereafter, residual toner on the surfaces of the photoreceptors Py to Pk is recovered and the surfaces are cleaned by photoreceptor cleaners CLy to CLk in cleaning zones Q4*y* to Q4*k*, and the photoreceptors Py to Pk are charged again by the charging rollers CRy to CRk.

The recording medium S onto which the toner images have been transferred is conveyed to a fusing zone Q5 which is formed by bringing a heating roller Fh, which constitutes an example of a heating fuser member, and a pressure roller Fp, which constitutes an example of a pressurizing fuser member of a fuser F, into press contact with each other, so that the toner images transferred on to the recording medium are fused. The recording medium S, on which the images are now fused, is guided by a guide roller Rgk and is then discharged on to the medium discharging tray TRh by sheet discharging rollers Rh, which constitute examples of medium discharging members.

The medium conveyance belt B, from which the recording medium has been separated, is cleaned by the belt cleaner CLb.

When double-side printing is performed, the sheet discharging roller Rh is driven to rotate reversely, so that the recording medium S is conveyed to a medium reversing path SH2 by a switching member GT1. The recording medium S is sent to the registration rollers Rr again with the front and back sides of the recording medium S inverted.

It is noted that the fuser F, the lower drive roller of the sheet discharging rollers Rh, the switching member GT1, a lower guide surface of the medium reversing path SH2 of the exemplary embodiment 1 are made into an integrated replaceable fusing unit, that is, a so-called fusing unit U3. In addition, the upper follower member of the sheet discharging rollers Rh is supported by the opening/closing portion U2.

(Description on Visualized Image Formation Unit)

Figure 4:
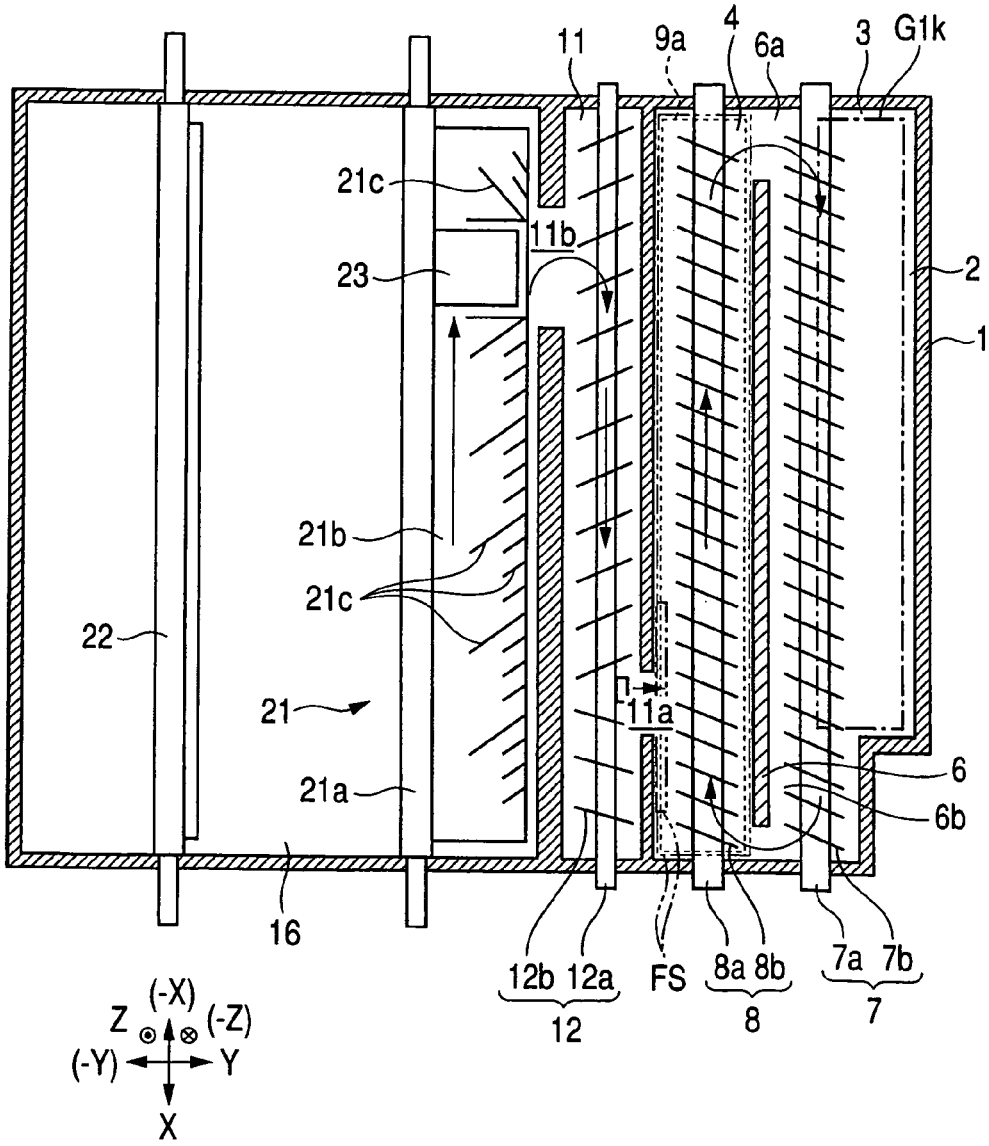
FIG. 4 is a section view taken along the line IV-IV of FIG. 3.

FIG. 4 is a section view taken along the line IV-IV in FIG. 3.

Hereinafter, detailed description of the visualized image formation units UY to UK will be made. Since the visualized image formation units UY to UK of the respective colors are configured similarly, only the visualized image formation unit UK for the black color will be described below, and the description of the other visualized image formation units UY, UM, UC will be omitted.

In FIGS. 3 and 4, the visualized image formation unit UK is configured by assembling together a developing section Uk1 which has the photoreceptor Pk and the developing unit Gk and a cleaning section Uk2 which has the charging roller CRk, the photoreceptor cleaner CLk and the charge eliminating roller Jk. A writing beam passage Uk3 is formed between the developing section Uk1 and the cleaning section Uk2. A laser beam Lk passes through the writing beam passage Uk3.

The developing section Uk has a developer accommodation container 1 which accommodates a developer therein. The developer accommodation container 1 has a lower developer container main body 1*a*, a lid member 1*b* which closes an upper side of the developer container main body 1*a*, and a center partition member 1*c* for partitioning the developer container main body 1*a* at a central portion in the right and left direction so as to define a developer conveyance chamber, which will be described later.

The developer accommodation container 1 has: a developer-carrying-body accommodation chamber 2, which constitutes an example of a developer carrying body facing the photoreceptor Pk; a first agitating conveyance chamber 3 which is disposed to be adjacent to a left side of the developer-carrying-body accommodation chamber 2 and which accommodates a developer therein; and a second agitating conveyance chamber 4 which is disposed to be adjacent to a left side of the first agitating conveyance chamber 3. In addition, a layer thickness controlling member SK is disposed in the developer-carrying-body accommodation chamber 2 so as to face a developing roller G1*k* and to control a layer thickness of a developer carried on a surface of the developing roller G1*k*.

The first agitating conveyance chamber 3 and the second agitating conveyance chamber 4, which constitute an example of the developer accommodation chamber, are partitioned by a partition wall 6. The first agitating conveyance chamber 3 and the second agitating conveyance chamber 4 are configured so that the developer can move therebetween through an outlet portion 6*a* and an inlet portion 6*b* which are formed in both front and rear end portions of the partition wall 6.

A two-component developer which contains toner and carrier is accommodated as the developer in the developer accommodation container 1 of the exemplary embodiment 1. In addition, a circulation conveyance chamber (3+4) includes the first agitating conveyance chamber 3 and the second agitating conveyance chamber 4. A developer accommodation chamber (2 to 4) includes the developer-carrying-body accommodation chamber 2 and the circulation conveyance chamber (3+4).

Agitating conveyance members 7, 8, each constituting an example of a developer conveyance member, for conveying the developer in opposite directions to each other while agitating the developer are disposed in the first agitating conveyance chamber 3 and the second agitating conveyance chamber 4, respectively. Each of the agitating conveyance members 7, 8 of the exemplary embodiment 1 includes an agitating conveyance member having a rotation shaft 7*a*, 8*a* and a spiral conveyance screw 7*b*, 8*b* which is fixedly supported by the rotation shaft 7*a*, 8*a*, that is, constitutes a so-called auger. A circulation conveyance member (7+8) of the exemplary embodiment 1 includes the pair of agitating conveyance members 7, 8.

Each of the agitating conveyance members 7, 8 of the exemplary embodiment 1 is set such that a diameter f of the rotation shaft is 4 mm, a spiral diameter which is an external diameter of the conveyance screw 7*b*, 8*b* is 8 mm, a pitch which is a distance over which the conveyance screw 7*b*, 8*b* moves in an axial direction per a single full spiral revolution of the conveyance screw 7*b*, 8*b* is 15 mm and the revolution speed is 408.39 rpm. It is noted that these values may be changed arbitrarily according to designs.

In FIG. 3, an initial developer accommodation chamber 9, which is disposed above the second agitating conveyance chamber 4, is formed in the lid member 1*b*. As shown by broken lines in FIG. 4, a opening 9*a* that extends in the anteroposterior direction is formed in a lower end portion of the initial developer accommodation chamber 9.

A cylindrical toner conveyance chamber 11, which constitutes an example of a developer conveyance chamber, is formed on the left side of the second agitating conveyance chamber 4. A toner supply port 11*a*, which constitutes an example of a toner supply portion and which connects to the second agitating conveyance chamber 4, is formed in a front end portion of the toner conveyance chamber 11, and this position is set to be a toner supply position as an example of a developer supply position. A toner inlet port 11*a*, which constitutes an example of a developer inlet port, is formed in a rear end portion of the toner conveyance chamber 11. A toner supply member 12, which constitutes an example of a developer supply member, is disposed in the toner conveyance chamber 11 for conveying the developer in the toner conveyance chamber 11 to the toner supply port 11*a* side.

In addition, the toner supply member 12 of the exemplary embodiment 1 is set so that a diameter of a rotation shaft 12*a* is 4 mm, a spiral diameter which is an external diameter of a conveyance screw 12*b* is 8 mm, a pitch which is a distance over which the conveyance screw 12*b* moves in an axial direction per a single full spiral revolution of the conveyance screw 12*b* is 8 mm and the revolution speed is 100 rpm. It is noted that these values may be changed arbitrarily according to designs.

A first toner supply chamber 16, which constitutes an example of a first developer supply chamber, is formed on the left side of the toner conveyance chamber 11. A second toner supply chamber 18, which constitutes an example of a second developer supply chamber, is disposed above the first toner supply chamber 16 so as to be connected to the first toner supply chamber 16 through a toner falling path 17, which constitutes an example of a developer falling path and which is formed in end portions of the first toner supply chamber 16 and the second toner supply chamber 18 in the anteroposterior direction. A first toner conveyance member 21 and a second toner conveyance member 22, which constitutes examples of developer supply members, are disposed in the first toner supply chamber 16 for conveying toner in the first toner supply chamber 16 to the toner inlet port 11*b*.

The first toner conveyance member 21 has a rotation shaft portion 21*a* and a conveyance film portion 21*b* which is supported by the rotation shaft portion 21*a* and which is made from a flexible resin film such as PET (polyethylene terephthalate). Notches 21*c* which are inclined relative to the axial direction are formed in the conveyance film portion 21*b*. An auxiliary film 23 is affixed to the conveyance film portion 21*b* in a position facing the toner inlet port 11*b* for enhancing the strength of the conveyance film portion 21*b* so as to facilitate the flow of toner into the toner inlet port 11*b*. Consequently, when the first toner conveyance member 21 rotates, toner is conveyed to the rear toner inlet port 11*b* side by the conveyance film portion 21*b* in which the notches 21*c* are formed. The toner is conveyed into the toner conveyance chamber 11 in the portion where the auxiliary film 23 is affixed.

The second toner conveyance member 22 conveys the toner to the first toner conveyance member 21 side. A third toner conveyance member 24 and a fourth toner conveyance member 26, which constitute examples of developer supply members and which are disposed in the second toner supply chamber 18 convey the toner in the second toner supply chamber 18 to the toner falling path 17 side.

A toner supply container (11+16+18), which constitutes an example of a developer supply container of the exemplary embodiment 1, includes the toner conveyance chamber 11, the first toner supply chamber 16 and the second toner supply chamber 18. A toner supply member, which constitutes an example of a developer supply member, includes the members denoted by reference numerals 12, 22, 22, 24 and 26.

The photoreceptor cleaner CLk is disposed on the right side of the second toner supply chamber 18. The photoreceptor cleaner CLk has: a plate-shaped image carrying body cleaning member which is brought into contact with the surface of the photoreceptor Pk, that is, a so-called cleaning blade 31; and a recovered toner conveyance member 33, which constitutes an example of a recovered developer conveyance member and which conveys the toner, paper powder, discharged product and the like which are scraped off the surface of the photoreceptor Pk by the cleaning blade 31 to a recovered toner accommodation chamber 32, which constitutes an example of a recovered developer accommodation chamber.

In FIG. 3B, a film seal FS, which constitutes an example of an opening/closing member as well as a partition member, is provided in the visualized image formation unit Uk. An outer end side of the film seal FS is led to the outside via a through hole (not shown) of the visualized image formation unit Uk, and an inner end side thereof is bifurcated. One of the bifurcated ends is affixed to a lower side of the opening 9*a*. In addition, as shown in FIG. 4, the other inner end side of the film seal FS is affixed to the toner supply port 11*a* of the toner conveyance chamber 11 so as to close the toner supply port 11*a*.

Consequently, the opening 9*a* is closed by the film seal FS, and the initial developer accommodation chamber 9 is sealed off. A seal is provided between the toner conveyance chamber 11 and the developer accommodation chamber (2 to 4).

In addition, in the exemplary embodiment 1, in the visualized image formation unit Uk in which the film seal FS is mounted, a two-component developer or a so-called initial developer in which toner and carrier are mixed together at a predetermined ratio which is set in advance is accommodated. A toner as a supply developer is accommodated in the developer supply container (11+16+18). In addition, the developer accommodation chamber (2 to 4) is held in such a state that no developer is accommodated. Consequently, since no developer exists in the developer accommodation chamber (2 to 4) in such a state where the film seal FS is attached and the developer accommodation chamber is sealed off, the leakage of developer is prevented during storage in a warehouse or transportation. By removing the film seal FS from the visualized image formation unit Uk before the visualized image formation unit Uk is installed in the image forming apparatus main body U1, the developer in the initial developer accommodation chamber 9 is allowed to flow into the developer accommodation chamber (2 to 4), and the toner is allowed to be supplied from the toner supply container (11+16+18).

The developer conveyance unit of the exemplary embodiment 1 includes the respective members which are denoted by reference numerals 1 to 26 and reference character FS.

(Description of Control Section)

Figure 5:
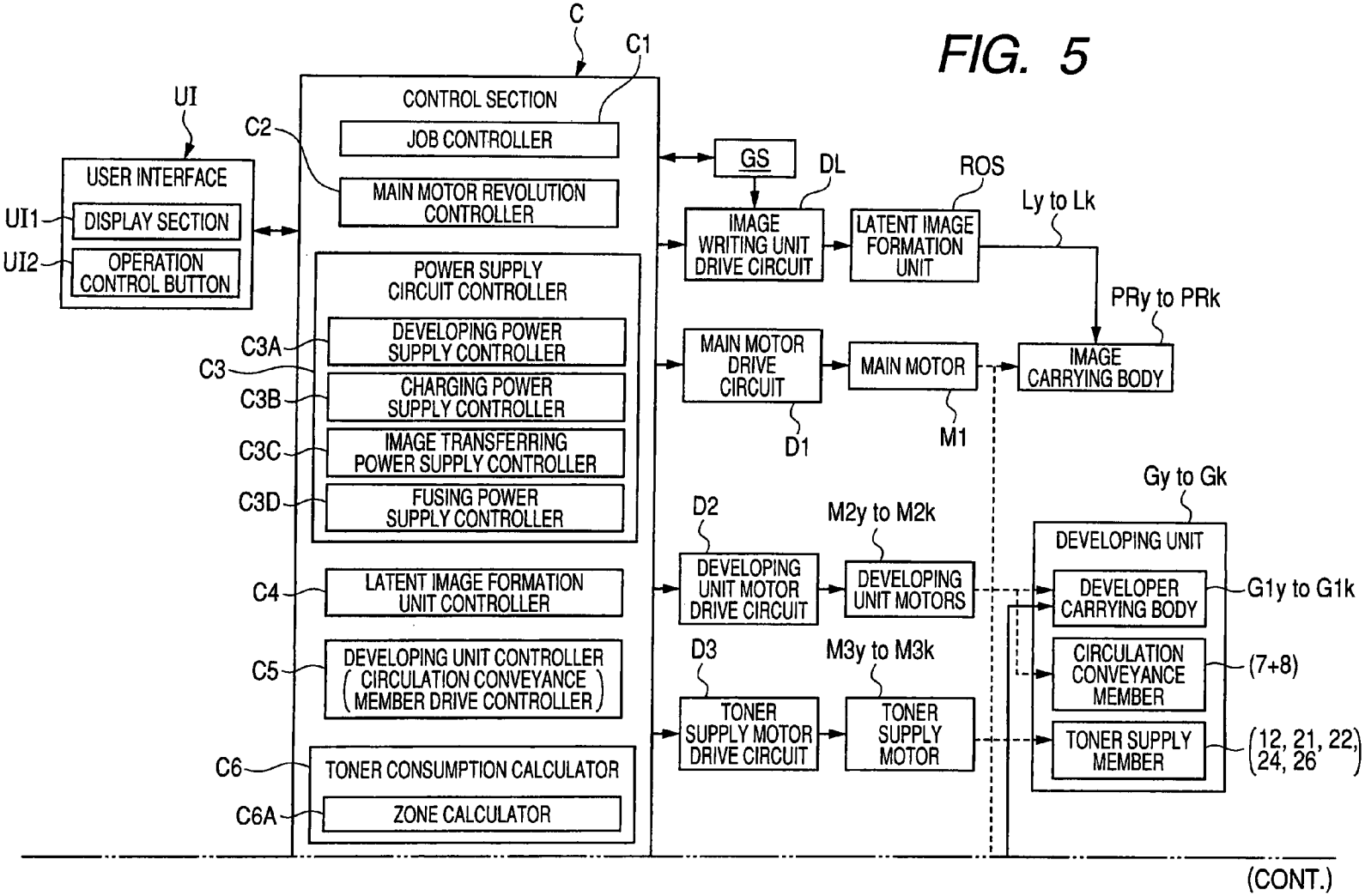
FIG. 5 is a block diagram of a control section of the image forming apparatus of the exemplary embodiment 1 of the invention.

FIG. 5 is a block diagram of the control section of the image forming apparatus of the exemplary embodiment 1.

In FIG. 5, the control section C includes: an input/output interface which performs input/output of signals with the outside and performs adjustment of input/output signal levels; a ROM (Read Only Memory) in which programs and data for executing necessary processes and the like are stored; a RAM (Random Access Memory) for temporarily storing necessary data; a central processing unit (CPU) for executing processes according to the programs stored in the ROM; and a computer having a clock generator. The control section C may realize various functions by executing the programs stored in the ROM.

(Signal Input Elements Connected to the Control Section C)

Signals from the operation section UI and other signal input elements are input into the control section C. The operation section U1 has a display section UI1, operation control buttons UI2 and the like.

(Control Elements Connected to the Control Section C)

In addition, the control section C is connected to a main motor drive circuit D1, a developing unit motor drive circuit D2, a developer supply motor drive circuit D3 and other control elements and outputs operation control signals for those control elements.

The main motor control circuit D1 drives rotating of the image carrying bodies PRy to PRk via a main motor M1, which constitutes an example of a main drive source.

The developing unit motor drive circuit D2 drives rotating of the developer carrying bodies Gy to Gk and the circulation conveyance member (7+8) via developing unit motors M2*y* to M2*k* which constitute drive sources for the developing units Gy to Gk.

The toner supply motor drive circuit D3 drives rotating of the toner supply members (12, 21, 22, 24, 26) of the developing units Gy to Gk via toner supply motors M3.

The power supply circuit E has a developing power supply circuit E1, a charging power supply circuit E2, an image transferring power supply circuit E3, a fusing power supply circuit E4 and the like.

The developing power supply circuit E1 applies a developing bias individually to the developing rollers G1*y* to G1*k* of the developing units Gy to Gk.

The charging power supply circuit E2 applies a charging bias individually to the charging rollers CRy to CRk.

The image transferring power supply circuit E3 applies an image transferring bias individually to the image transfer rollers T1*y* to T1*k*.

The fusing power supply circuit E4 supplies a heating current to the heating roller Fh of the fusing unit F.

(Functions of the Control Section C)

The control section C has a function to execute processes according to input signals from the signal output elements to output control signals to the respective control elements.

Namely, the control section C has the following functions.

C1: Job Controller

A job controller C1, which constitutes an example of an image recording controller, controls the operations of the latent image formation unit ROS, the photoreceptors PRy to PRk, the image transfer rollers T1*y* to T1*k* and the fusing unit F. The job controller C1 executes a job which is an image formation operation in response to a printing request from the image information transmitting unit.

C2: Main Motor Rotation Controller

A main motor rotation controller C2 controls a main motor M1 via the main motor drive circuit D1 so as to control the driving of the photoreceptors PRy to PRk and the like.

C3: Power Supply Circuit Controller

A power supply circuit controller C3 has a developing power supply controller C3A, a charging power supply controller C3B, an image transferring power supply controller C3C and a fusing power supply controller C3D, and controls power supplies to the respective members of the image forming apparatus U by controlling the power supply circuit E.

C3A: Developing Power Supply Controller

The developing power supply controller C3A controls a developing voltage by controlling the developing power supply circuit E1.

C3B: Charging Power Supply Controller

The charging power supply controller C3B controls a charging voltage by controlling the charging power supply circuit E2.

C3C: Image Transferring Power Supply Controller

The image transferring power supply controller C3C controls an image transferring voltage by controlling the image transferring power supply circuit E3.

C3D: Fusing Power Supply Controller

The fusing power supply controller C3D controls the fusing temperature of the fusing unit F by controlling the fusing power supply circuit E4.

C4: Latent Image Formation Unit Controller

A latent image formation unit controller C4 controls the latent image formation unit ROS via the image writing unit driving circuit DL or the like, so as to form electrostatic latent images on the surfaces of the photoreceptors PRy to PRk.

C5: Developing Unit Controller (Circulation Conveyance Member Driving Controller)

A developing unit controller C5 controls the developing unit motors M2*y* to M2*k* via the developing motor drive circuit D2, so as to control the rotations of the developer carrying bodies G1*y* to G1*k* of the developing units Gy to Gk and the circulation conveyance member (7+8).

Figure 6A:
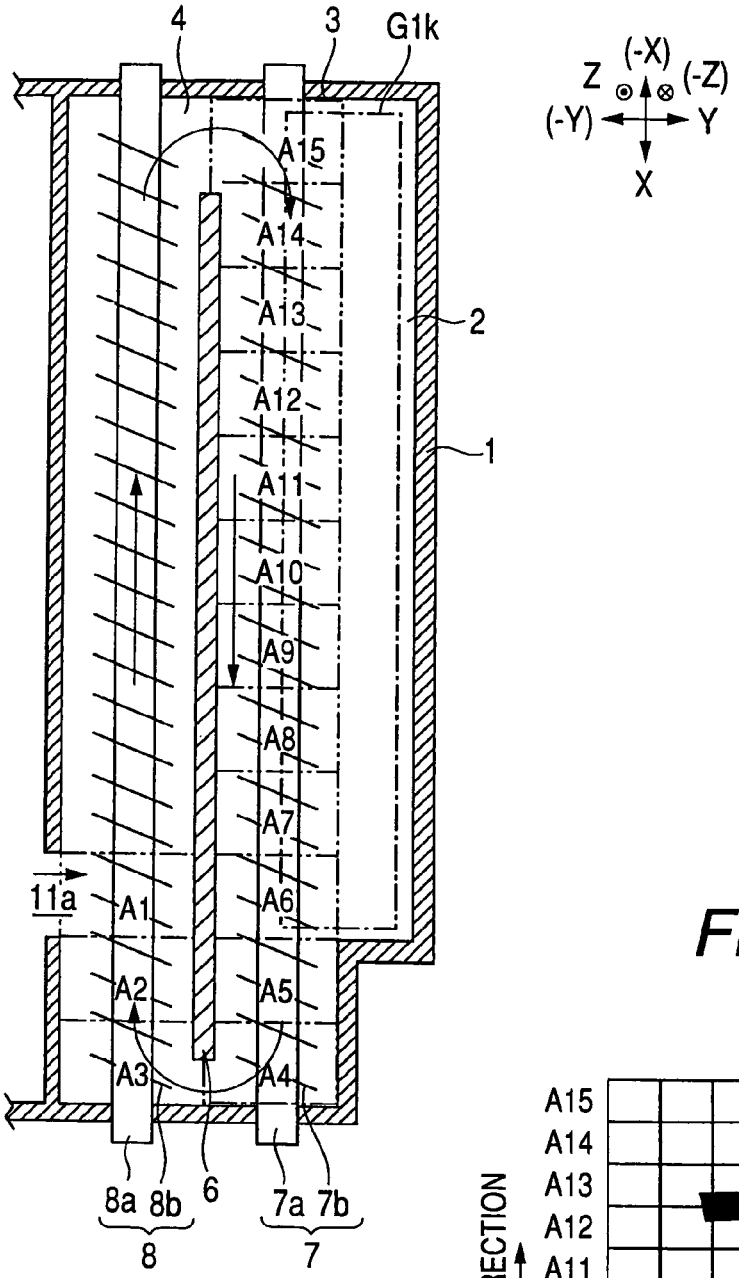
FIG. 6A is an explanatory drawing which explains a relationship between the developer accommodation chamber and the accumulated consumption calculation zones.
Figure 6B:
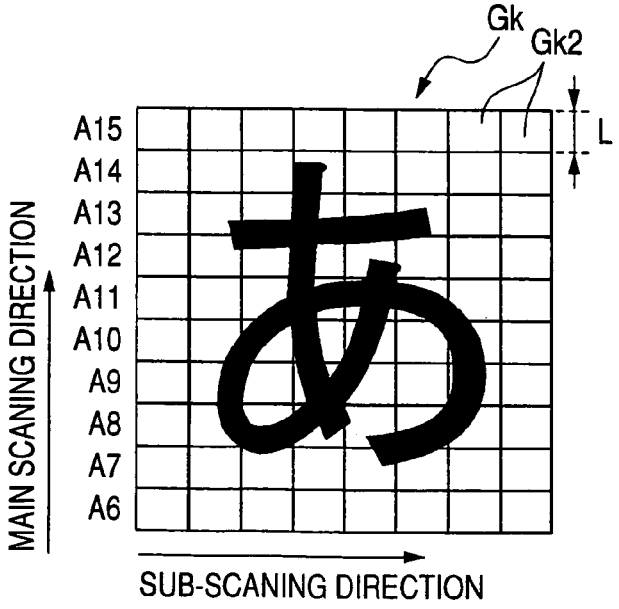
FIG. 6B is an explanatory drawing which explains a relationship between an image formed and the accumulated consumption calculation zones.

FIG. 6 shows explanatory drawings of accumulated consumption calculation zones of the exemplary embodiment 1. FIG. 6A is an explanatory drawing which explains a relationship between the developer accommodation chamber and the accumulated consumption calculation zones. FIG. 6B is an explanatory drawing which explains a relationship between an image formed and the accumulated consumption calculation zones.

C6: Toner Consumption Calculator (Developer Consumption Calculator)

A toner consumption calculator C6, which constitutes an example of a developer consumption calculator, has an a zone calculator C6A. The toner consumption calculator C6 calculates toner amounts consumed by the developing units Gy to Gk to form an image. In FIG. 6, the toner consumption calculator C6 of the exemplary embodiment 1 calculates a toner consumption in each of plural consumption calculation zones A1 to A15, based on an accumulated number of pixels at the time of image formation. The circulation conveyance chamber (3+4) is divided into the plural consumption calculation zones A1 to A15 having a predetermined range along the conveyance direction.

In FIG. 6A, in the exemplary embodiment 1, a part of the circulation conveyance chamber (3+4) is divided into the accumulated consumption calculation zones A1 to A15 having a predetermined area along the conveyance direction of the developer. The accumulated consumption calculation zones A1 to A15 of the exemplary embodiment 1 are set sequentially from the accumulated consumption calculation zone A1 corresponding to the developer supply port 11*a*, the zone A2, the zone A3, . . . towards the upstream side of the developer conveyance direction. The developing zone Qgk corresponding to a zone from one end portion to the other end portion of the developer carrying body G1*y* to G1*k* is divided into the ten zones A6 to A15. Consequently, also with regard to the image formed, an image formation zone GK is, as shown in FIG. 6B, imaginarily divided into plural consumption calculation zones GKi along a main scanning direction and a sub-scanning direction in such a manner as to correspond to the accumulated consumption calculation zones A6 to A15 of the developing zone. In the exemplary embodiment 1, a length L, in the developer conveyance direction, of each of the accumulated consumption calculation zones A1 to A15 may be set to be proportional to a developer conveyance speed v of the developer conveyance member 8. Specifically, the length L may be equal to a distance by which the developer is conveyed for a zone shift time t1, which will be described later. It takes the zone shift time t for the developer in the upstream-side accumulated consumption calculation zone A2 to be conveyed to the downstream-side accumulated consumption calculation zone A1. That is, $L=v\times t1$. Alternatively, the length L may be equal to an integral multiple of $v\times t1$. Also, a length of the consumption calculation zone GKi of the image formation zone GK may be set to, for example, be proportional to a circumferential length by which the photoreceptors PRy to PRk rotate in the zone shift time t1.

C6A: Calculator

The zone calculator C6A counts and calculates number of pixels or dots which are written by the latent image formation unit ROS when an image is formed, for each of the accumulated consumption calculation zones A1 to A15. At this time, in the exemplary embodiment 1, a unit consumption Ns0 is added to a consumption Ns every time the counted number of pixels reaches Ng. The number of pixels Ng and the unit consumption Ns0 may be set arbitrarily according to design, specification and the like of the image forming apparatus U. For example, those values may be set such that Ng=100[dots], Ns0=0.1 [μg].

C7: Toner Balance Storage (Developer Consumption Storage)

A toner balance storage C7, which constitutes an example of a developer consumption storage, has a zone storage C7A and a total toner consumption storage C7B. The toner balance storage C7 stores a difference between an amount of toner supplied to the developer accommodation chambers (2 to 4) and a consumed toner amount, that is, a balance of toner in amount.

C7A: Zone Storage

The zone storage C7A stores a consumed toner amount and a supplied toner amount for each of the accumulated consumption calculation zones A1 to A15, that is, a toner balance in each zone.

C7B: Total Toner Balance Storage

The total toner balance storage C7B stores a total balance of the toner in the developer accommodation chambers (2 to 4). Namely, the total toner balance storage C7B stores a total toner balance which is a total of balances of all the accumulated consumption calculation zones A1 to A15.

C8: Consumption Shift Unit

A consumption shift unit C8 has a zone shift time storage C8A and a shift time counting timer TM1. The consumption shift unit C8 shifts consumptions in the respective accumulated consumption calculation zones A1 to A15 to the respective accumulated consumption calculation zones A1 to A15 which is on the downstream side in the developer conveyance direction, in response to the conveyance of developer by the circulation conveyance member (7+8). The consumption shift unit C8 of the exemplary embodiment 1 shifts consumptions every time the zone shift time t1 has elapsed. In addition, in the exemplary embodiment 1, a balance "0" is input in the upstreammost accumulated consumption calculation zone A15 on the assumption that a developer which is supplied according to the consumption in the toner supply position is conveyed from the upstream side.

C8A: Zone Shift Time Storage

The zone shift time storage C8A stores the zone shift time t1 which is spent to shift a consumption (balance) value in a upstream-side accumulated consumption calculation zone to a downstream-side accumulated consumption calculation zone. Also, in the exemplary embodiment 1, the zone shift time t1 is used as an example of a time interval at which a consumption of toner is calculated, and a time necessary for the developer in the upstream-side accumulated consumption calculation zone A2 is conveyed to the downstream-side accumulated consumption calculation zone A1 is set as the zone shift time t1.

TM1: Shift Time Counting Timer

The shift time counting timer TM1 counts the zone shift time t1.

C9: Toner Supply Controller (Developer Supply Controller)

A toner supply controller C9 has a supply completion determination unit C9A. The toner supply controller C9 controls the toner supply motors M3*y* to M3*k*, which constitute examples of developer supply motors, via the toner supply motor drive circuit D3, which constitutes an example of a developer supply motor drive circuit so as to control the toner supply members 12, 21, 22, 24, 26. Thereby, the toner supply controller C9 controls the supplying of toner. In addition, the toner supply controller C9 of the exemplary embodiment 1 drives the toner supply motors M3*y* to M3*k* only for a predetermined unit supply time during which a predetermined unit supply amount of toner is supplied to the developer accommodation chambers (2 to 4). Also, the toner supply controller C9 controls the number of times the toner supply motors M3*y* to M3*k* are driven. Thereby, supply amounts are controlled.

C9A: Supply Completion Determination Unit

The supply completion determination unit C9A determines as to whether or not a supply operation is completed. When the total toner balance takes a negative value, that is, the amount of toner consumed is large, the supply completion determination unit C9A of the exemplary embodiment 1 permits the supply operation. Thereby, the supply operation continues. Also, when the total balance takes 0 or a positive value, that is, the supplied toner amount is equal to or larger than the consumed toner amount, the supply operation is stopped. In addition, in the exemplary embodiment 1, although the configuration does not allow the total toner balance to exceed 0, if the total toner balance becomes positive due to a failure of the control section C or the like, the supply operation is not executed. As a result, the leakage of developer from the developing units Gy to Gk is prevented.

C10: Supply Amount Setting Unit

A supply amount setting unit C10 sets a supply amount from the toner supply port 11*a* based on the consumption in the accumulated consumption calculation zone A1 which corresponds to the toner supply position. The supply amount setting unit C10 of the exemplary embodiment 1 sets a supply amount by setting the number of times of driving the toner supply members 12, 21, 22, 24, 26 according to the consumption in the accumulated consumption calculation zone A1. It is noted that the toner supply members 12, 21, 22, 24, 26 supply a unit supply amount per single drive.

Description of Flowchart of Exemplary Embodiment 1

Next, The operation of the exemplary embodiment 1 of the invention will be described with reference to a flowchart. Here, for the purpose of simplicity, omitted will be illustration and description on a process for supplying toner by driving the toner supply members 12, 21, 22, 24, 26 set number of times of driving every time the number of times of driving is set according to a supply amount.

(Description of Developer Consumption Calculation Process)

Figure 7:
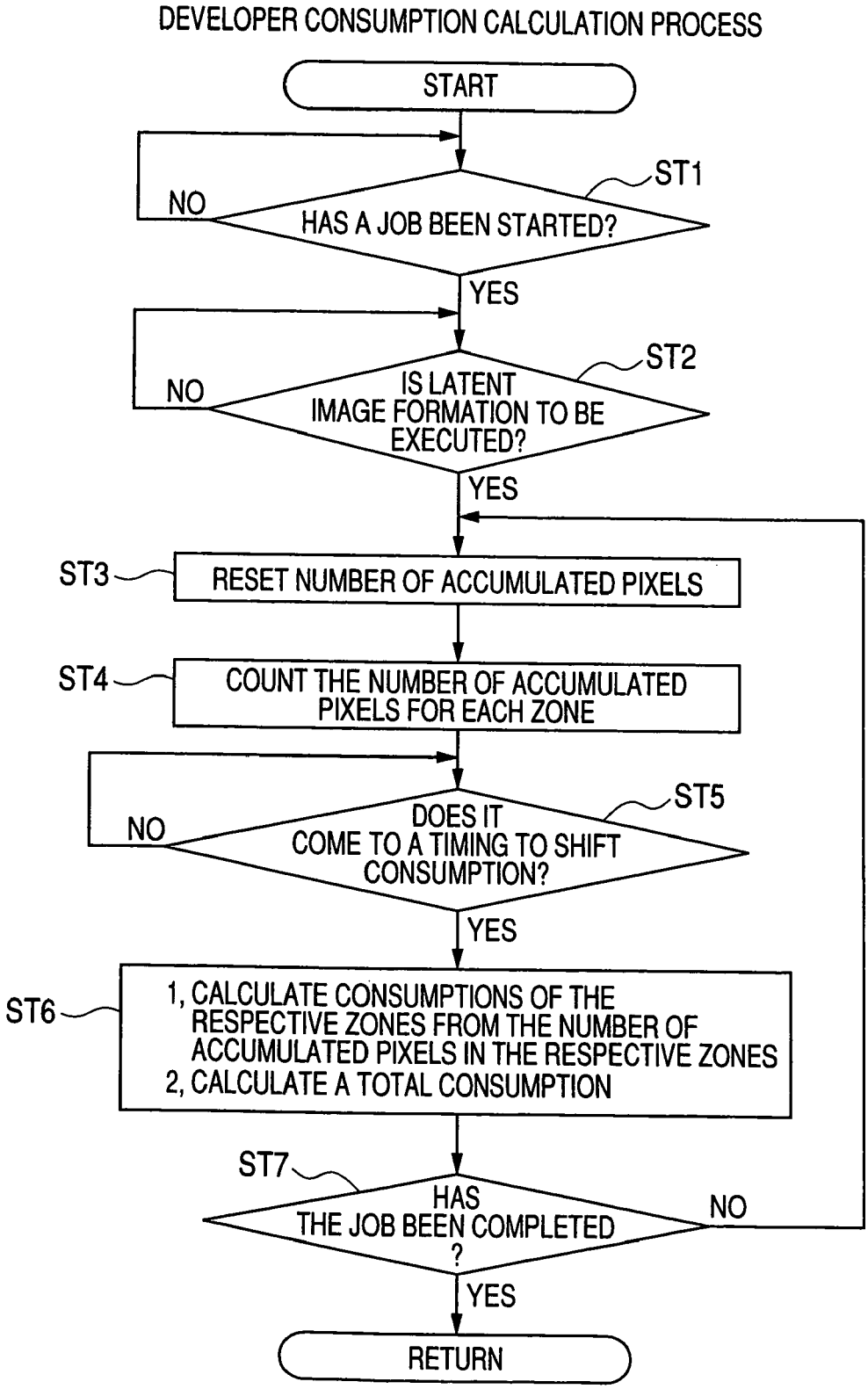
FIG. 7 is a flowchart of a developer (toner) consumption calculation process in the image forming apparatus of the exemplary embodiment 1 of the invention.

FIG. 7 is a flowchart of a developer (toner) consumption calculation process in the image forming apparatus of the exemplary embodiment 1 of the invention.

A process at each ST (step) of the flowchart shown in FIG. 7 is performed according to the programs stored in the ROM of the control section C. In addition, these processes are executed in parallel with other various processes of the image forming apparatus.

The developer (toner) consumption calculation process shown in FIG. 7 is started when the power supply of the image forming apparatus is turned on.

At ST1 in FIG. 7, it is determined as to whether or not a job, which is an image formation operation, has been started. If yes (Y), then, the process proceed to ST3, whereas if no (N), the process at ST1 is repeated.

At ST2, it is determined as to whether of not a latent image formation by the latent image formation unit ROS has been executed. If yes (Y), then, the process proceeds to ST3, whereas if no (N), the process at ST2 is repeated.

At ST3, all count values of number of accumulated pixels are initialized, that is, reset. Then, the process proceeds to ST4.

At ST4, it is started to count the number of accumulated pixels for each of the accumulated consumption calculation zones A6 to A15 in response to writing of an image by the latent image formation unit ROS. Then, the process proceeds to ST5.

At ST5, it is determined as to whether or not it comes to the timing at which the consumption shift unit C8 shifts the consumption in each of the accumulated consumption calculation regions A6 to A15, that is, the toner balance in each zone toward the downward side. In other words, it is determined as to whether or not it comes to the timing at which consumptions are shifted. If yes (Y), then, the process proceeds to ST6, whereas if no (N), the process at ST5 is repeated.

At ST6, the following processes (1), (2) are executed, and then, the process proceeds to ST7.

(1) Toner consumptions in the respective accumulated consumption calculation zones A6 to A15 are calculated from the counted number of accumulated pixels in the respective zones, and the toner balances in the respective zones are updated.

(2) A total consumption is calculated from a total sum of all the toner consumptions, and the total toner balance is updated.

At ST7, it is determined as to whether the job has been completed. If no (N), then, the process returns to ST3, whereas if yes (Y), the process returns to ST1.

(Description of Supply Amount Setting process)

Figure 8:
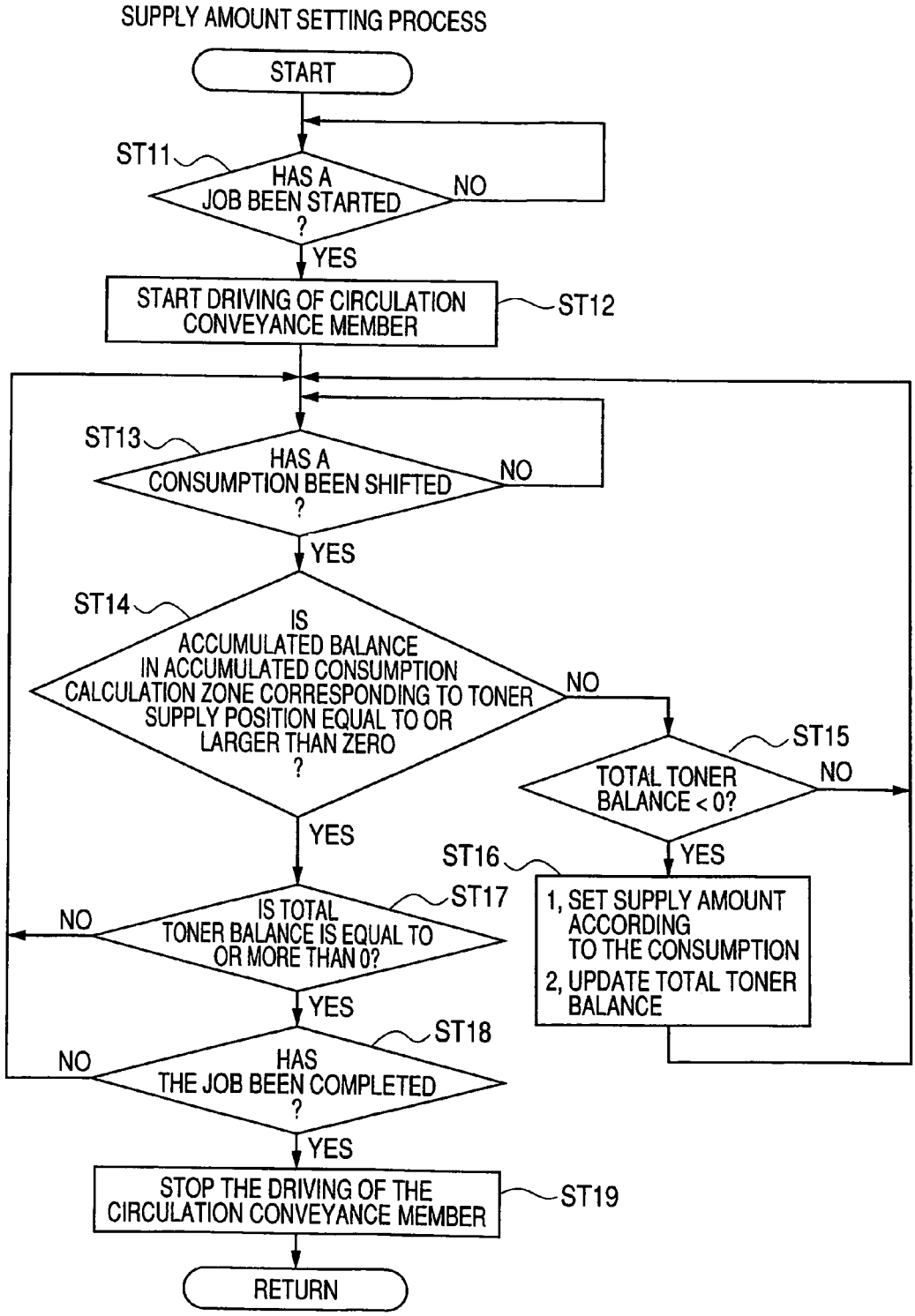
FIG. 8 is a flowchart of a supply amount setting process in the image forming apparatus of the exemplary embodiment 1 of the invention.

FIG. 8 is a flowchart of a supply amount setting process in the image forming apparatus of the exemplary embodiment 1 of the invention.

A process at each ST (step) of the flowchart shown in FIG. 8 is performed according to the programs stored in the ROM of the control section C. Also, these processes are executed in parallel with other various processes of the image forming apparatus.

A supply amount calculation process shown in FIG. 8 is started when the power supply of the image forming apparatus is turned on.

At ST11 in FIG. 8, it is determined as to whether or not a job has been started. If yes (Y), then, the process proceeds to ST12, whereas if no (N), the process at ST11 is repeated.

At ST12, it is started to drive the circulation conveyance member (7+8). Then, the process proceeds to ST13.

At ST13, it is determined as to whether or not a process of shifting consumptions, that is, toner balances of the accumulated consumption calculation zones A1 to A15 has been executed. If yes (Y), the process proceed to ST14, whereas if no (N), the process at ST13 is repeated.

At ST14, it is determined as to whether or not the consumption, that is, the toner balance in the accumulated consumption calculation zone A1 which corresponds to the toner supply position is equal to or larger than 0. If no (N), the process proceeds to ST15, whereas if yes (Y), the process proceeds to ST17.

At ST15, it is determined as to whether or not the total toner balance is less than 0. If yes (Y), the process proceeds to ST16, whereas if no (N), the process returns to ST13.

At ST16, the following processes (1), (2) are executed, and then, the process returns to ST13.

(1) A toner supply amount is set based on the consumption of the accumulated consumption calculation zone A1 in the toner supply position. Namely, in the exemplary embodiment 1, the numbers of times the toner supply members 12, 21, 22, 24, 26 are driven are set based on the consumption.

(2) The total toner balance is updated. Namely, the consumption is subtracted from the total toner balance before updated, and the set supply amount is added thereto. Thereby, a new total toner balance is calculated. At this time, the supply amount is reflected to the toner balance in the accumulated consumption calculation zone A1 which corresponds to the toner supply position, and in the exemplary embodiment 1, the consumption becomes 0.

At ST17, it is determined as to whether or not the total toner balance is equal to or more than 0. Namely, it is determined as to whether or not the toner supply corresponding to the toner consumption has been executed. If yes (Y), the process proceeds to ST18, whereas if no (N), the process returns to ST13.

At ST18, it is determined as to whether or not the job has been completed. If yes (Y), the process proceeds to ST19, whereas if no (N), the process returns to ST13.

At ST19, the driving of the circulation conveyance member (7+8) is stopped. Then, the process returns to ST11.

(Description of Consumption Shift Process)

Figure 9:
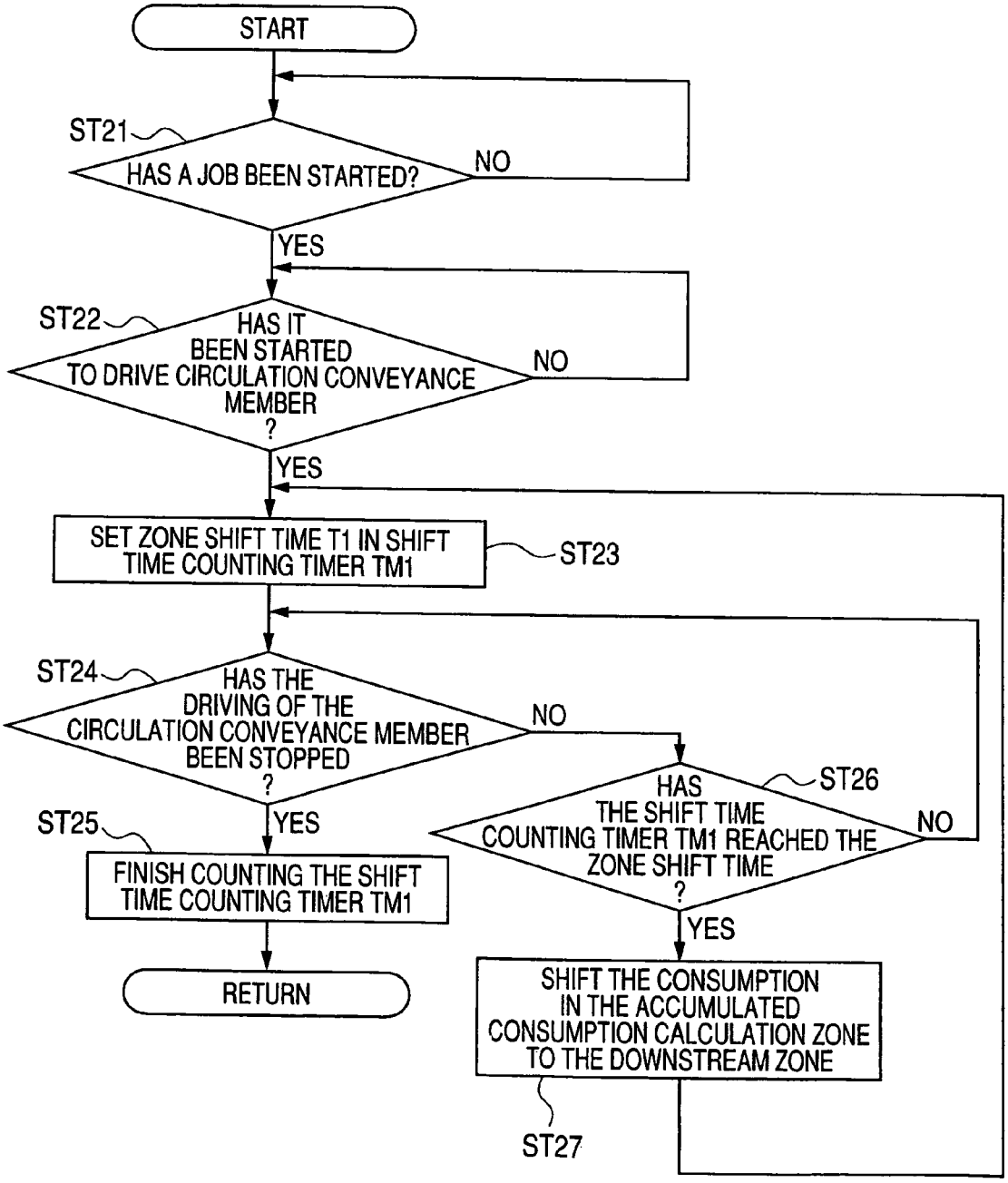
FIG. 9 is a flowchart of a consumption shift process in the image forming apparatus of the exemplary embodiment 1 of the invention.

FIG. 9 is a flowchart of a consumption shift process in the image forming apparatus of exemplary embodiment 1 of the invention.

A process at each ST (step) of the flowchart shown in FIG. 9 is performed according to the programs stored in the ROM of the control section C. Also, these processes are executed in parallel with other various processes of the image forming apparatus.

The consumption shift process shown in FIG. 9 is started when the power supply of the image forming apparatus is turned on.

At ST21 in FIG. 9, it is determined as to whether or not a job has been started. If yes (Y), the process proceeds to ST22, whereas if no (N), the process at ST21 is repeated.

At ST22, it is determined as to whether or not it has been started to drive the circulation conveyance member (7+8). If yes (Y), the process proceeds to ST23, whereas if no (N), the process at ST22 is repeated.

At ST23, the zone shift time t1 is set in the shift time counting timer TM1. Then, the process proceeds to ST24.

At ST24, it is determined as to whether or not it has been stopped to drive the circulation conveyance member (7+8). If yes (Y), the process proceeds to ST25, whereas if no (N), the process proceeds to ST26.

At ST25, the counting by the shift time counting timer TM1 is stopped, and the process returns to ST21.

At ST26, it is determined as to whether or not the shift time counting timer TM1 has reached the zone shift time t1. If yes (Y), the process proceeds to ST27, whereas if no (N), the process returns to ST24.

At ST27, the consumptions, that is, the values of toner balances of the accumulated consumption calculation zones A1 to A15 are shifted to the down stream zones. When they are shifted, the original value stored in the downstreammost A1 is discarded, and 0 is newly set in the upstreammost zone A15. Then, the process returns to ST23.

Operation of Exemplary Embodiment 1

In the above printer U which constitutes the example of the image forming apparatus of the exemplary embodiment 1 and which includes the respective constituent components, an electrostatic latent image is formed in conjunction with image formation. When the toner in the developing units Gy to Gk is consumed, the values of the toner balances in the accumulated consumption calculation zones A6 to A15, which correspond to the zones where the toner is consumed, change as shown at ST2 and ST3 in FIG. 7. Then, as the image formation operation continues, that is, the circulation conveyance members (7+8) of the developing units Gy to Gk are driven, the toner balances in the accumulated consumption calculation zones A1 to A15 are also shifted to the downstream zones as shown at ST27 in FIG. 9. Then, when any of the accumulated consumption calculation zones A1 to A15 where the toner is consumed are shifted to the accumulated toner consumption calculation zone A1 corresponding to the toner supply position, a toner supply amount is set according to the toner balances, and the toner is supplied. Namely, in the developer which circulates in the circulation conveyance chamber (3+4), when a part where the toner is consumed arrives at the toner supply position, a supply process according to the consumption is performed.

Figure 10:
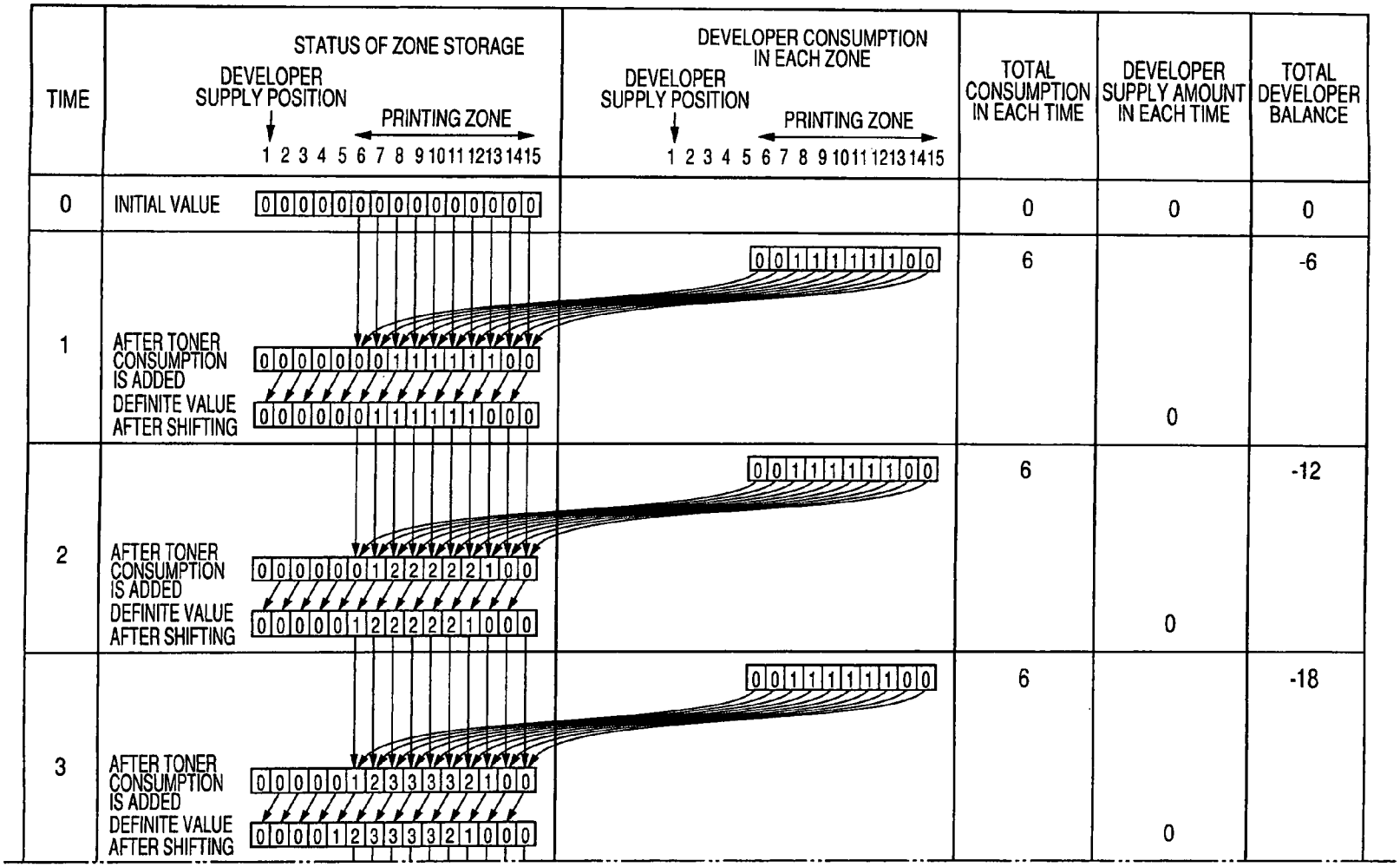
FIG. 10 is an explanatory drawing of operations of the exemplary embodiment 1.

FIG. 10 is an operation explanatory drawing.

In FIG. 10, a specific example will be described in which an image is formed over only zones corresponding to the zones A8 to A13 of the accumulated consumption calculation zones A6 to A15 which correspond to a printing zone. Also, for the purpose of facilitating of understanding of the description, it is assumed that a toner consumption for a time t1 in each printing zone is one unit. In a state before an image formation operation is started, all toner balances in the respective zones and a total toner balance are zero as shown at a time zero.

In this state, if an image is printed over the zones which correspond to the zones A8 to A13, the toner balances corresponding to A8 to A13 become one. As the zone shift time t1 has elapsed and it comes to a time 1, the values "1" which are values of the zones A1 to A15, in particular, the zones A8 to A13 are shifted to the zones A7 to A12 which is on the downstream side thereof, respectively. At this time, the total sum of the consumptions becomes six, and no supply is performed. Therefore, the total toner balance becomes minus six, which is a total sum in the zones A8 to A13.

Subsequently, when an image is printed over the zones which correspond to the zones A8 to A13, since the values "1" are stored in the zones A7 to A12 as the toner balances, consumptions are added to these values. Thereby, the toner balances become 2, and the toner balance of the zone A13 becomes 1. Then, when the zone shift time t1 has elapsed and it comes to the time 2, the values of the zones A1 to A15 are shifted to the downstream side.

The image formation, addition and shift of the consumptions occur successively in this way. When the value of toner balance in the accumulated consumption calculation zone A1 which corresponds to the toner supply position takes a value other than zero at a time 7, a supply amount "1" is set for the consumption "1." Thereby, supply according to the consumption is performed.

Then, a total toner balance is also calculated in response to the addition and shift of the consumption in conjunction with the image formation.

Even though latent images continue to be formed until a time 15 and the job is completed at the time 15, the conveyance by the circulation conveyance member (7+8) still continues, the toner balances in the accumulated consumption calculation zones A1 to A15 are shifted and the toner is supplied according to the toner balance in the zone located at the toner supply position.

Then, when the total toner balance becomes equal to zero, that is, all the toner balances in the respective zones become equal to zero, it is stopped to drive the circulation conveyance member (7+8), and the series of operations is completed.

Exemplary Embodiment 2

Figure 11:
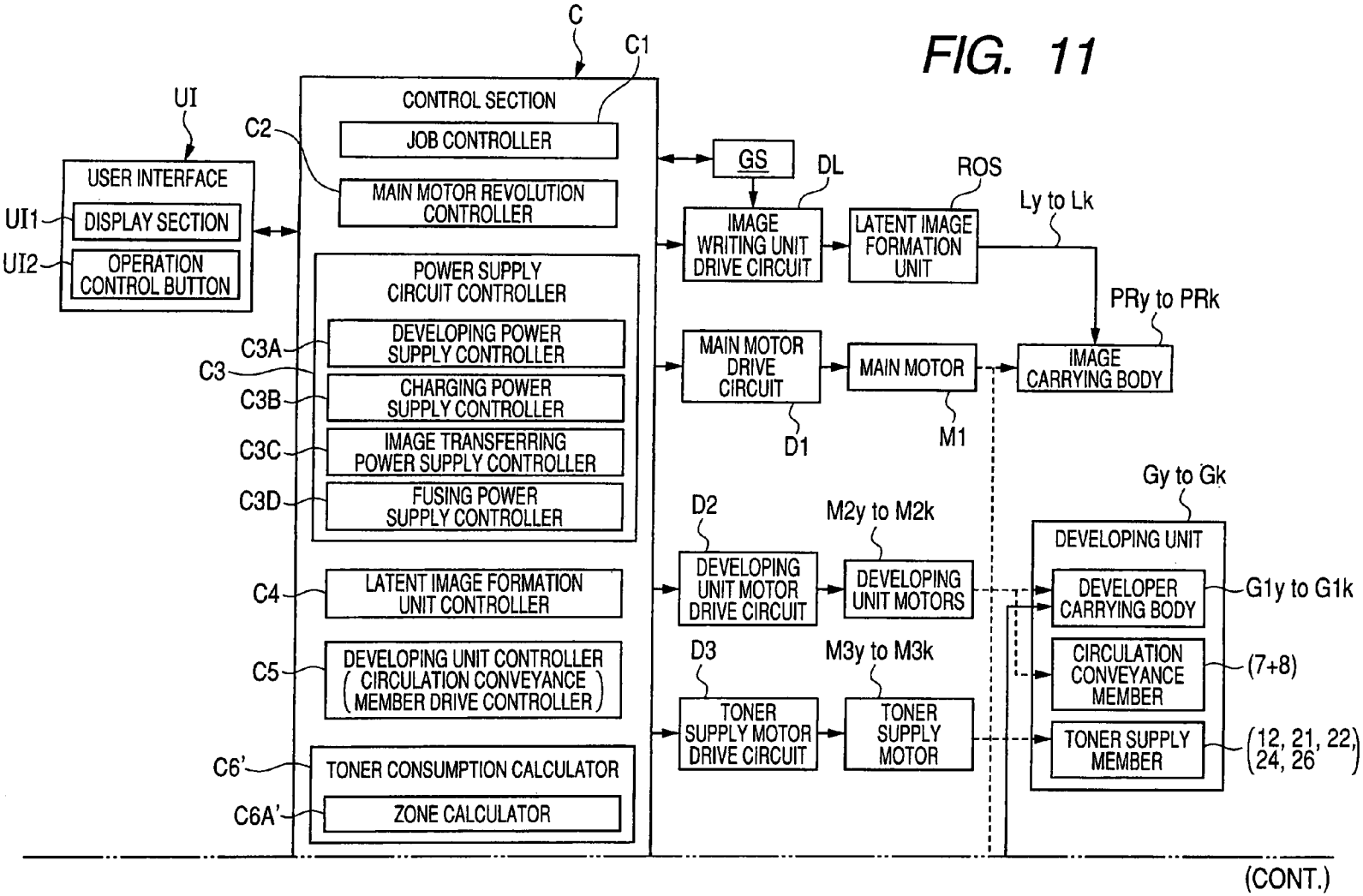
FIG. 11 is a block diagram of a control section of an image forming apparatus of an exemplary embodiment 2 of the invention, which is a drawing corresponding to FIG. 5 of the exemplary embodiment 1.

FIG. 11 is a block diagram of a control section of an image forming apparatus of an exemplary embodiment 2 of the invention and corresponds to FIG. 5 showing the exemplary embodiment 1.

Next, the image forming apparatus of the exemplary embodiment 2 will be described. In the description of the exemplary embodiment 2, similar reference numerals will be given to elements similar to those of the exemplary embodiment 1, and the description thereof will be omitted. Although the exemplary embodiment 2 is different from the exemplary embodiment 1 in the following point, the exemplary embodiment 2 is configured similarly to the exemplary embodiment 1 with respect to the other points.

In FIG. 11, in the image forming apparatus of the exemplary embodiment 2, in place of the toner consumption calculator C6, the zone storage C7A, the total toner balance storage C7B, the supply completion determination unit C9A and the supply amount setting unit C10 of the exemplary embodiment 1, a toner consumption calculator C6', a zone storage C7A', a total toner balance storage C7B', a supply completion determination unit C9A' and a supply amount setting unit C10' are provided.

Figure 12:
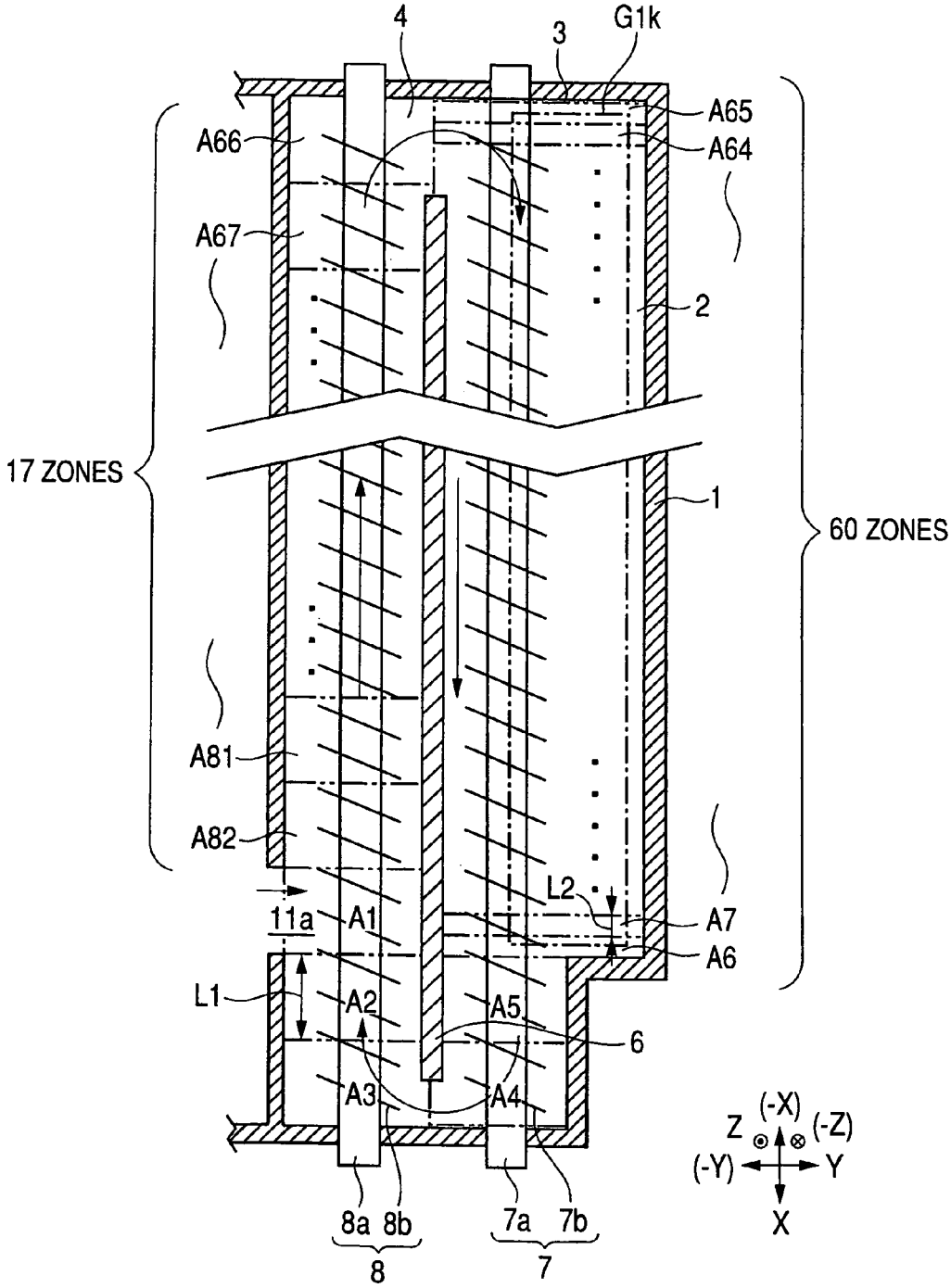
FIG. 12 is an explanatory drawing of a developing chamber and accumulated consumption calculation zones of the exemplary embodiment 2, which is a drawing corresponding to FIG. 6A of the exemplary embodiment 1.

FIG. 12 is an explanatory drawing of developer accommodation chambers and accumulated consumption calculation zones of the exemplary embodiment 2. FIG. 12 corresponds to FIG. 6A of the exemplary embodiment 1.

C6': Toner Consumption Calculator

The toner consumption calculator C6' has a zone calculator C6A' and calculates amounts of toner consumed in the developing units Gy to Gk to form an image. In FIG. 12, the toner consumption calculator C6' of the exemplary embodiment 2 is different from the toner consumption calculator C6 of the exemplary embodiment 1 in that the entire circulation conveyance chamber (3+4) is divided into 82 accumulated consumption calculation zones A1 to A82. In the exemplary embodiment 2, in a portion which corresponds to an image formation zone of the first agitating conveyance chamber 3, a part of a developer adheres to the developing rollers G1*y* to G1*k* from the developer carrying body accommodating chamber 2 and conveyed to the developing zones. Thereafter, the toner is returned to the first agitating conveyance chamber 3 and conveyed to the downstream side. Consequently, an actual conveyance speed of developer becomes slower in a portion where the developer-carrying-body accommodation chamber 2 is provided than that in portions where the developer-carrying-body accommodation chamber 2 is not provided. In the exemplary embodiment 2, in order to calculate a consumption of toner with better accuracy, the size of the accumulated consumption calculation zones A1 to A82 are set according to the actual developer conveyance speed. A length L of each of the zones A1 to A82 along the developer conveyance direction is set to meet $L=v\times t1$ where v denotes the actual developer conveyance speed in each zone and t1 denotes the zone shift time which constitutes an example of a unit time. Because of this, as shown in FIG. 12, a length L2 of each of the accumulated consumption calculation zones A6 to A65 which correspond to the portion where the developer-carrying-body accommodation chamber 2 is provided is set shorter than a length L1, along a developer conveyance direction, of each of the accumulated consumption calculation zones A1 to A5, A66 to A82 which correspond to the portions where the developer-carrying-body accommodation chamber 2 is not provided.

Also, the toner consumption calculator C6' of the exemplary embodiment 2 calculates a toner consumption in each of the accumulated consumption calculation zones A6 to A65 based on number of accumulated pixels calculated by the zone calculator C6A' when an image is formed. At this time, the toner consumption calculator C6' of the exemplary embodiment 2 adds a unit consumption Ns0 to a consumption Ns every time the counted number of pixels reaches Ng. The number of pixels Ng and the unit consumption Ns0 may be set arbitrarily according to design, specification and the like of the image forming apparatus U. For example, those parameters may be set as Ng=100[dots] and Ns0=0.1[μg]. Also, in the exemplary embodiment 2, when the consumption is shifted, the value of the zone A1 is shifted to the zone A82.

C7A': Zone Storage

The zone storage C7A' stores a toner consumption and a toner supply amount, that is, a toner balance in each of the accumulated consumption calculation zones A1 to A82.

C7B': Total Toner Balance Storage

The total toner balance storage C7B' stores a total sum of the toner balances in the developer accommodation chambers (2 to 4). Namely, the total toner balance storage C7B' stores a total toner balance which is a total sum of the balances between an amount of toner supplied by the toner supply member 12 and a total consumption of toner which is based on the number of accumulated pixels in the accumulated consumption calculation zones A6 to A65.

C9A': Supply Completion Determination Unit

The supply completion determination unit C9A' determines as to whether or not a supply operation is completed. The supply completion determination unit C9A' of the exemplary embodiment 2 permits the supply operation so that the supply operation continues when the total toner balance takes a negative value, that is, the toner consumed is larger than the supplied toner amount. In addition, When the total toner balance takes zero or a positive value, that is, toner is supplied more than consumed, the supply operation is stopped.

C10': Supply Amount Setting Unit

The supply amount setting unit C10' sets a supply amount from the toner supply port 11*a* based on the consumption in the accumulated consumption calculation area A1 which corresponds to the toner supply position. The supply amount setting unit C10' of the exemplary embodiment 2 sets a supply amount by setting the numbers of times of driving toner supply members 12, 21, 22, 24, 26 in which only a unit supply amount is supplied in a single drive. In addition, in the exemplary embodiment 2, in order to enhance the accuracy of control, the unit consumption Ns is set to a smaller value than the unit supply amount Nh which is supplied through the single drive of the toner supply members 12, 21, 22, 24, 26. The supply amount setting unit C10' of the exemplary embodiment 2 calculates a minimum integer Nh which enables a supply amount=(unit supply amount Nh)×(integer nh) to be equal to or larger than a consumption=(unit consumption Ns)×(integer ns based on number of accumulated pixels), and sets the calculated nh as the number of times of driving nh.

Description of Flowchart of Exemplary Embodiment 2

Next, the operation of exemplary embodiment 2 of the invention will be described with reference to a flowchart. A developer (toner) consumption calculation process and a process of controlling the drive of the toner supply members 12, 21, 22, 24, 26 are similar to those of the exemplary embodiment 1 except arguments such as the number of zones A1 to A82, that is, a parameter. Therefore, the illustrations and descriptions of those operations will be omitted here.

Also, a consumption shift process of the exemplary embodiment 2 is similar to that of the exemplary embodiment 1 except a parameter. Since the zones A1 to A82 in the exemplary embodiment 2 correspond to a circulation path, when shifting at ST27, the toner balance in the zone A82 is not reset to zero but shifted to the zone A1.

(Supply Amount Setting Process)

Figure 13:
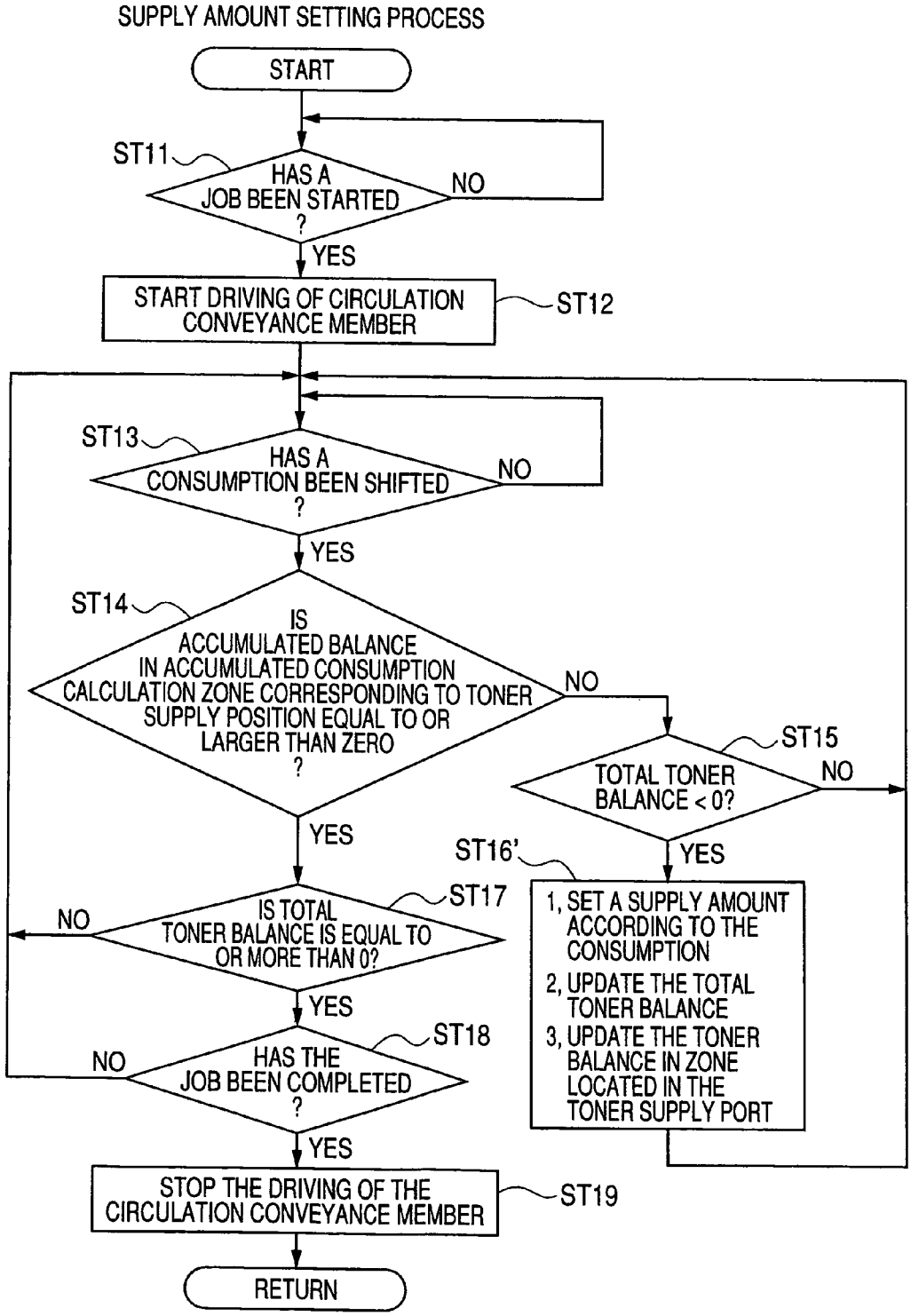
FIG. 13 is a flowchart of a supply amount setting process in the image forming apparatus of the exemplary embodiment 2 of the invention.

FIG. 13 is a flowchart of a supply amount setting process of the exemplary embodiment 2 and is a drawing which corresponds to FIG. 8 of the exemplary embodiment 1.

In addition, the supply amount setting process of the exemplary embodiment 2 is different from that of the exemplary embodiment 1 only in a process at ST16' when compared with the flowchart of the exemplary embodiment 1 shown in FIG. 8. Therefore, only ST16' will be described. With regard to the other steps, similar ST numbers will be given to similar steps to those of the exemplary embodiment 1, and description thereof will be omitted.

At ST16' in FIG. 13, the following processes (1) to (3) are executed.

(1) A supply amount of toner is set based on the consumption in the accumulated consumption calculation zone A1 at the toner supply position. Namely, in the exemplary embodiment 2, the number of times the toner supply members 12, 21, 22, 24, 26 are driven is set based on the consumption. At this time, when the supply amount is equal to or more than a toner amount which can be supplied within the time t1, the number of times the toner supply members 12, 21, 22, 24, 26 are driven is set such that a maximum amount can be supplied within the time t1.

(2) The total toner balance between supply and consumptions is updated. Namely, the consumptions are subtracted from the total toner balance before the update and the set supply amount is added thereto. Thereby, a new total toner balance is calculated.

(3) The supply amount is reflected onto the toner balance in the accumulated consumption calculation zone A1 which corresponds to the toner supply position to thereby carry out the update. At this time, when the toner supply amount is suppressed to a maximum value, a toner balance in each zone after the update does not become zero but takes a negative value.

Operation of Exemplary Embodiment 2

In the image forming apparatus of the exemplary embodiment 2 which is configured as above, the entire developer accommodation chambers (2 to 4) is divided into the accumulated consumption calculation zones A1 to A82, and the respective zones have sizes according to the actual developer conveyance speeds in the respective zones in order to enhance the accuracy of calculation of the consumptions and supply amount. Also, the consumption in each of the zones thus configured is calculated from the number of accumulated pixels based on the unit consumption Ns, and the supply is carried out based on the unit supply amount Nh. In the exemplary embodiment 2, since the unit consumption Ns is smaller than the unit supply amount Nh, if the consumption is equal to or less than the unit supply amount, although toner is supplied more than consumed. However, as shown at ST14 in FIG. 13, if the total toner balance takes a positive value, the supply of toner is not permitted, and hence, no toner is supplied. Also, if the consumption is equal to or larger than the toner amount which can be supplied within the time t1, since the toner supply amount is suppressed to the maximum amount that can be supplied within the time t1, the toner balance in each zone is shifted while the shortfall toner amount is stored.

EXPERIMENTAL EXAMPLES

In order to verify the advantage of the exemplary embodiments of the invention, the following experiments 1, 2 and comparison examples 1, 2 are carried out. The configuration of the exemplary embodiment 2 is adopted in carrying out the experimental examples. The experiments are carried out under the following experimental conditions. As to the conveyance speeds of toner which is accommodated in the developer accommodation chambers (2 to 4), the toner conveyance speed is set to 38.9 mm/s in the portions where the developer-carrying-body accommodation chamber 2 is not provided, whereas the toner conveyance speed in the portion where the developer-carrying-body accommodation chamber 2 is present is set to about 30% of 39 mm/s, that is, 11.7 mm/s. The one full circulation length of the circulation path in the developer accommodation chambers (2 to 4) is 467 mm, the length L1 of the accumulated consumption calculation zones A1 to A5, A66 to A82 which are in the portion where the developer-carrying-body accommodation chamber 2 is not provided is 11.7 mm. The length L2 of the accumulated consumption calculation zones At to A65 which are in the portion where the developer carrying body chamber 2 is present is 3.5 mm. The total amount of toner that is accommodated in the developer accommodation chambers (2 to 4) is 64 g, the consumption speed of toner when forming a solid image on an A4-size paper is 0.18 g/sec, the toner supply speed by the toner supply member 12 is 0.60 g/sec and the minimum drive time per a single drive of the toner supply member 12 is 30 msec. Namely, the unit supply amount of toner is 0.60 mg/sec×30 msec=1.8 μg.

Experiment 1

In Experiment 1, as in the exemplary embodiment 2, the toner balances in the respective accumulated consumption calculation zones A1 to A82 are calculated, and a supply amount is set according to the consumption in the zone A1 which corresponds to the toner filling position, that is, according to the toner balance in each zone, so as to carry out toner supply.

A printed image is an A4-size printed image whose width is 210 mm which corresponded to the overall width of the developing rolls G1*y* to G1*k*. A band of the solid image is formed in upstream third of the printing zone made up of the zones A6 to A65 in the developer conveyance direction, that is, in the range of the zones A45 to A63. Also, a halftone image having 50% in density for verification is formed at a lower end (a downstream side in the sub-scanning direction) of the image along its full width (a full width in the main scanning direction). Experiments are carried out regarding a toner balance when this image are printed 10 pages continuously and a transition in toner density between the upstream-end zone A65 and the downstream-end zone A4 in a first agitating conveyance chamber 3, and the experimental results are shown in FIG. 14. A toner density can be measured by a conventionally known toner density sensor such as a magnetic permeability sensor.

Comparison Example 1

Being different from the exemplary embodiment 2, in Comparison Example 1, a supply operation for supplying toner is carried out at a point in time at which the number of accumulated pixels exceeds a predetermined value, even though the zone where toner is consumed has not been shifted to a toner supply position. A printed image which is the same as that of Experiment 1 is employed.

Figure 14A:
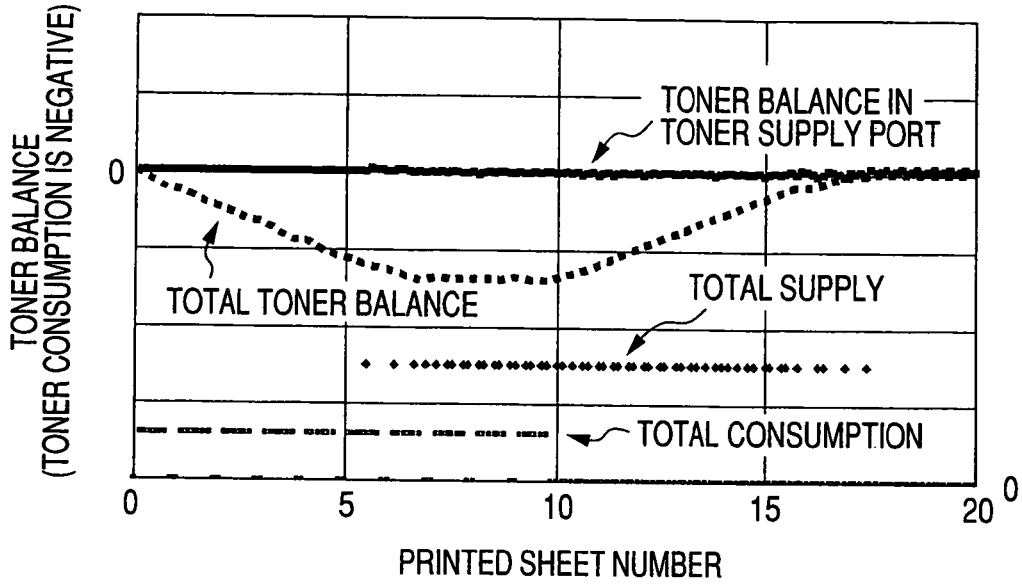
FIG. 14A is a graph showing a relationship between printed-sheet number and a toner balance, a toner supply timing and a toner consumption timing.
Figure 14B:
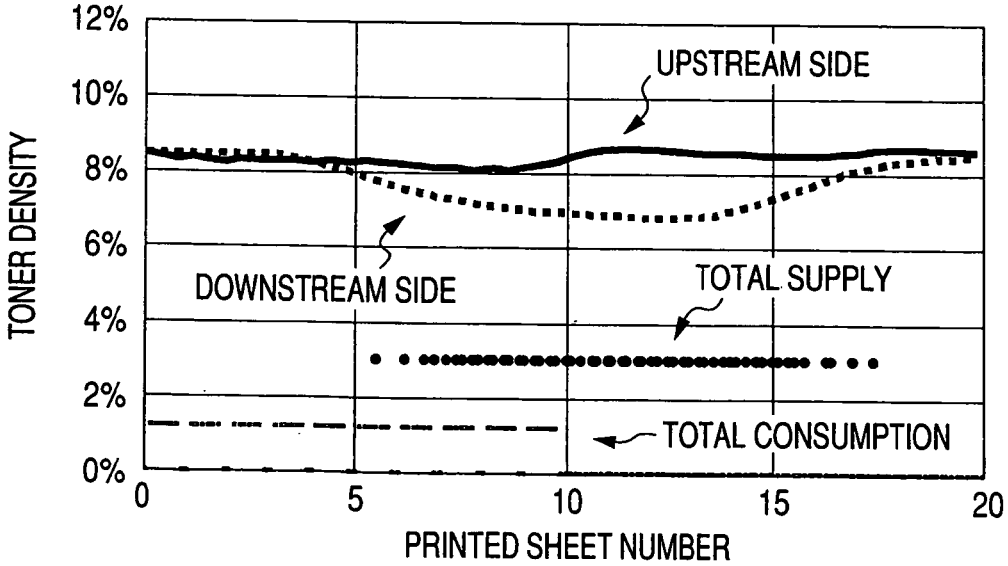
FIG. 14B is a graph showing a relationship between toner densities on an upstream side and a downstream side and a printed-sheet number, a toner supply timing and a toner consumption timing.

FIG. 14 shows graphs showing the experiment results of Experiment 1. FIG. 14A is a graph showing a relationship between printed-sheet number and a toner balance, a toner supply timing and a toner consumption timing. FIG. 14B is a graph showing a relationship between toner densities on the upstream side and downstream side and the printed-sheet number, the toner supply timing and the toner consumption timing.

Figure 15A:
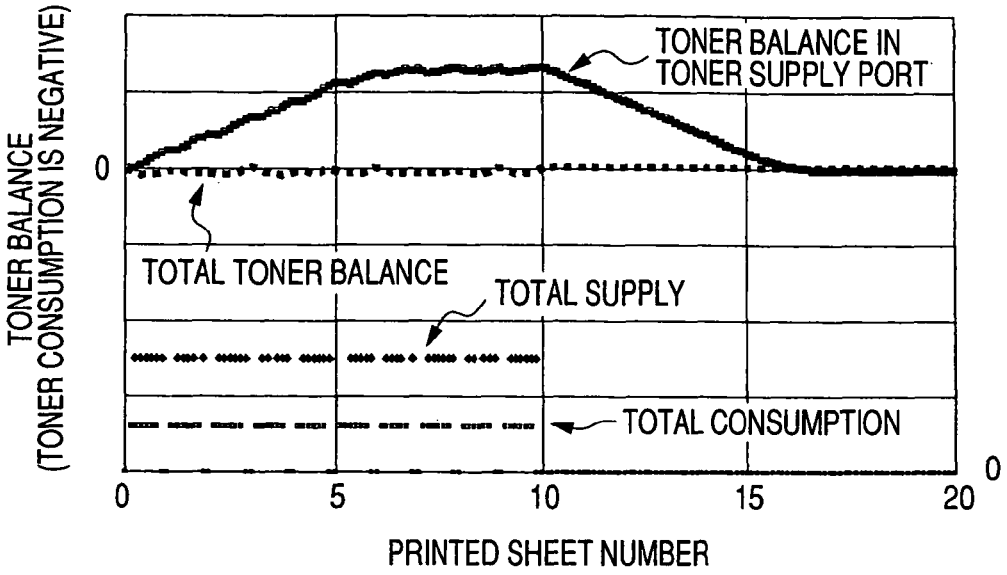
FIG. 15A is a graph showing a relationship between a printed-sheet number and a toner balance, a toner supply timing and a toner consumption timing.
Figure 15B:
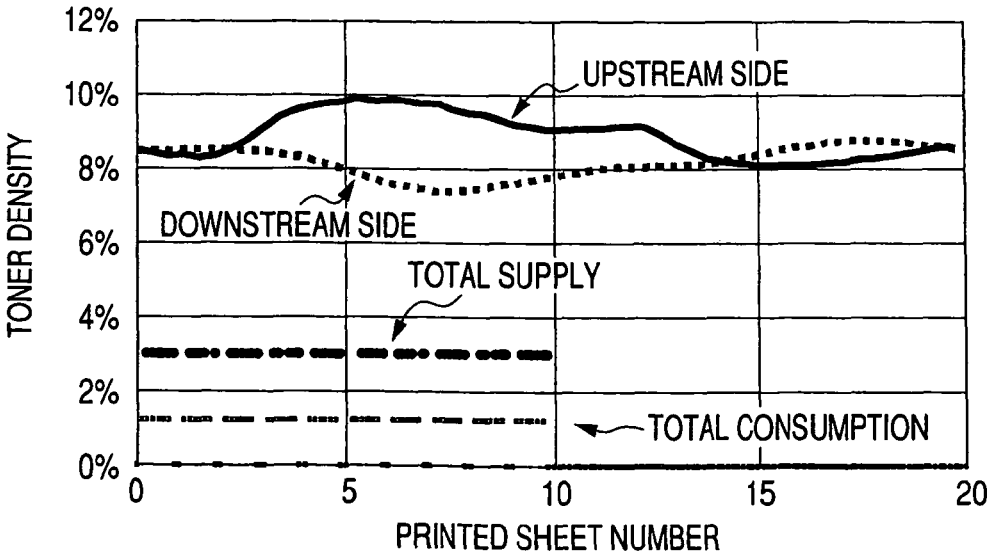
FIG. 15B is a graph showing a relationship between toner densities on an upstream side and a downstream side and a printed-sheet number, a toner supply timing and a toner consumption timing.

FIG. 15 shows graphs showing the experiment results of Comparison Example 1. FIG. 15A is a graph showing a relationship between the printed-sheet number and the toner balance, the toner supply timing and the toner consumption timing. FIG. 15B is a graph showing a relationship between the toner densities on the upstream side and downstream side and the printed-sheet number, the toner supply timing and the toner consumption timing.

In FIG. 14, toner is consumed every time images are formed on recording sheets S which are conveyed at predetermined sheet intervals in the Example 1. However, since the upstream-side accumulated consumption calculation zone where a solid image is formed and toner is consumed is not shifted to the toner supply position, that is, the position of the toner supply port 11, the supply is not carried out initially and the total toner balance decreases. Since the developer in which toner has been consumed is conveyed to the toner supply port 11*a* during printing of a sixth sheet, the toner supply is carried out according to the toner balance in the zone A1. At this time, in FIG. 14B, the difference in toner density between the upstream side and the downstream side remains within 1.3% on the tenth page, and the difference in density is not so conspicuous as to be visually recognized when the halftone image for verification is checked. Although the toner density difference becomes a maximum of 1.9% on the $12^{th}$ page, since there is formed no image, no problem arises.

In contrast to this, in Comparison example 1, as shown in FIG. 15A, the supply of toner is started immediately after it is started to form images. Toner is supplied even to the zones A1 to A45 where no toner is consumed. Namely, since the positions to which toner is supplied are different from the positions in which toner is consumed, the toner density difference became a maximum of 2.5% on the seventh page as shown in FIG. 15B. When a halftone image is checked, the toner density difference is visually recognized as a right and left difference in printing density in the width direction.

Experiment 2

In Experiment 2, an experiment is carried out under the experimental conditions described above with a printed image different from that of Experiment 1, and the other conditions are the same. Namely, in Experiment 2, a band of the solid image is formed in downstream third of the printing zone made up of the zones A6 to A65 in the developer conveyance direction, that is, in the range of the zones A8 to A26. Also, a halftone image having 50% in density for verification is formed at a lower end (the downstream side in the sub-scanning direction) of the image along its full width (a full width in the main scanning direction) The experimental results are shown in FIG. 16.

Comparison Example 2

In Comparison Example 2, an experiment is carried out under the same conditions as those of Comparison Example 1 with only the same printed image as that of Experiment 2 being used. The experimental results are shown in FIG. 17.

Figure 16A:
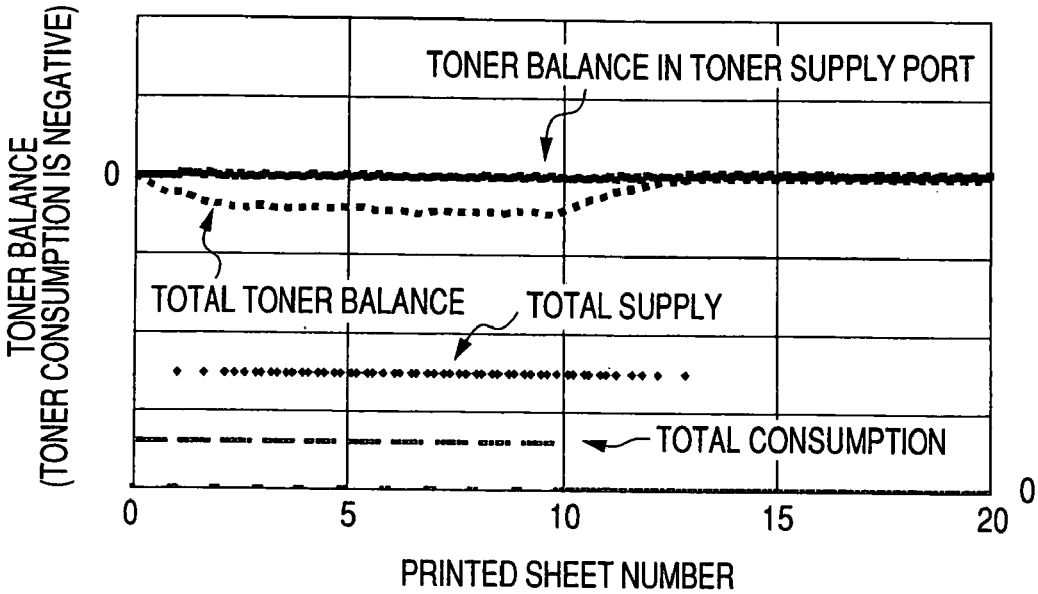
FIG. 16A is a graph showing a relationship between the printed-sheet number and the toner balance, the toner supply timing and the toner consumption timing.
Figure 16B:
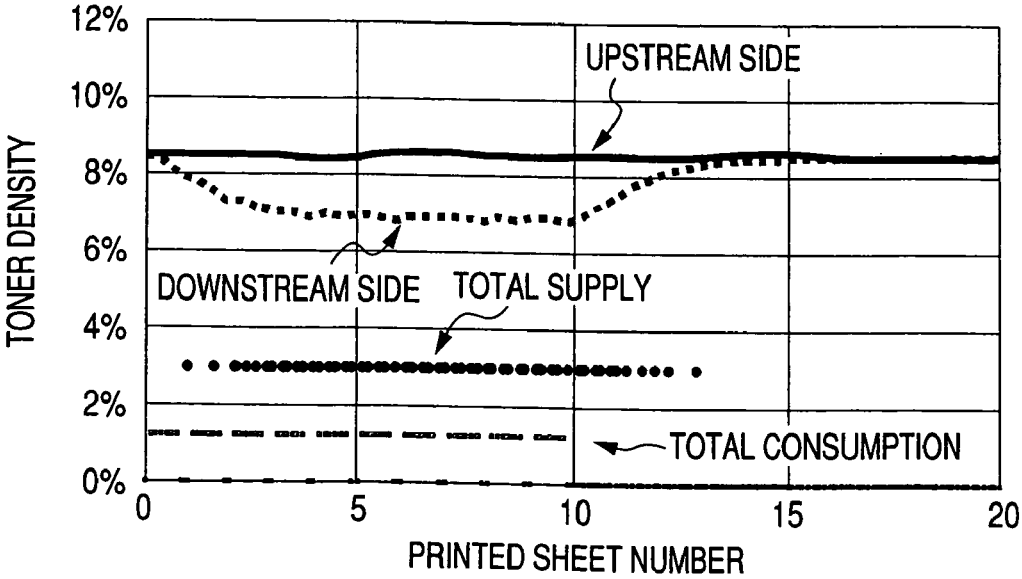
FIG. 16B is a graph showing a relationship between the toner densities on the upstream side and the downstream side and the printed-sheet number, the toner supply timing and the toner consumption timing.

FIG. 16 shows graphs showing the experiment results of Experiment 2. FIG. 16A is a graph showing a relationship between printed-sheet number and a toner balance, a toner supply timing and a toner consumption timing. FIG. 16B is a graph showing a relationship between toner densities on the upstream side and downstream side and the printed-sheet number, the toner supply timing and the toner consumption timing.

Figure 17A:
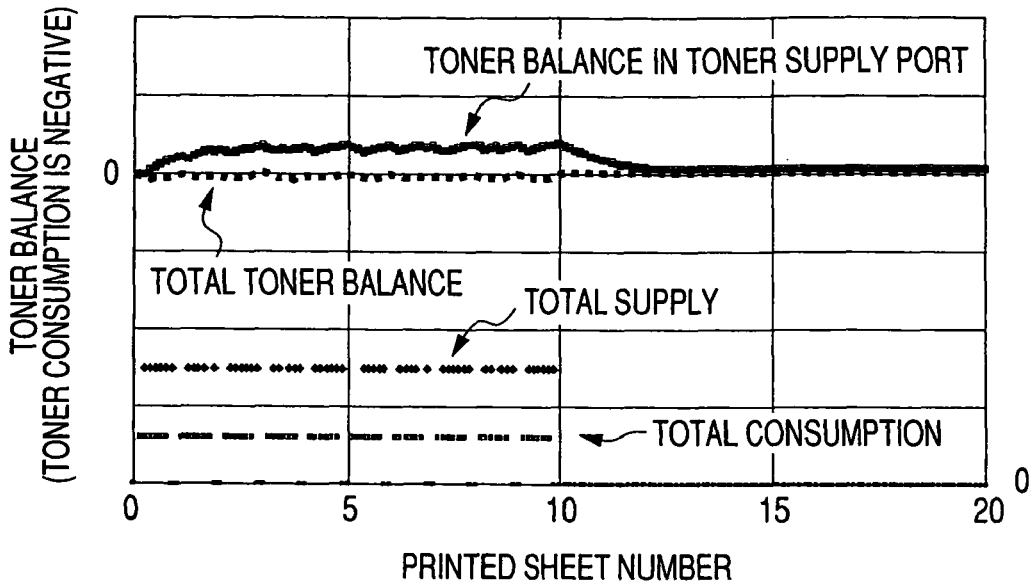
FIG. 17A is a graph showing a relationship between the printed-sheet number and the toner balance, the toner supply timing and the toner consumption timing.

FIG. 17 shows graphs showing the experiment results of Comparison Example 2. FIG. 17A is a graph showing a relationship between printed-sheet number and a toner balance, a toner supply timing and a toner consumption timing.

Figure 17B:
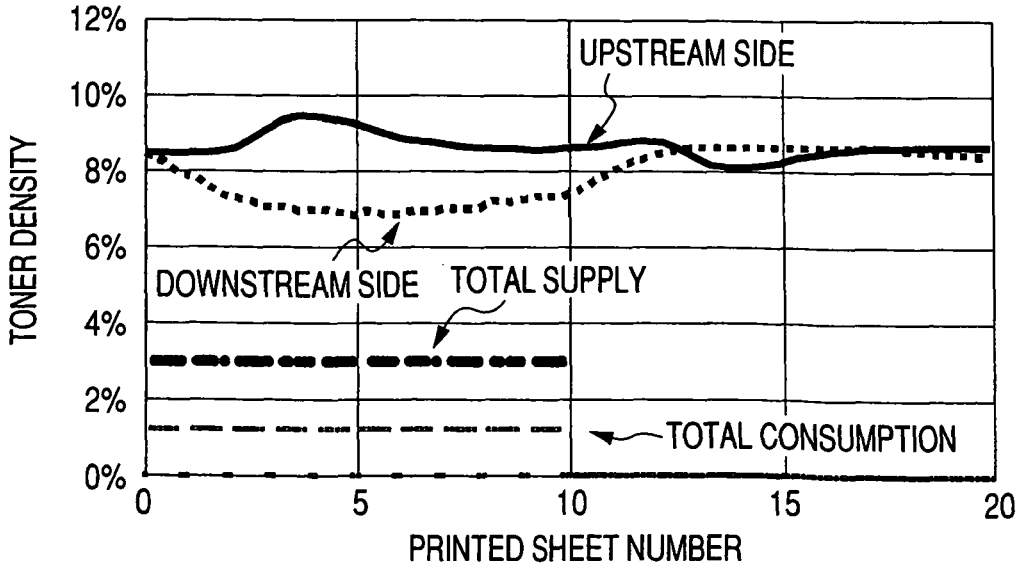
FIG. 17B is a graph showing a relationship between the toner densities on the upstream side and the downstream side and the printed-sheet number, the toner supply timing and the toner consumption timing.

FIG. 17B is a graph showing a relationship between toner densities on the upstream side and downstream side and the printed-sheet number, the toner supply timing and the toner consumption timing.

In FIG. 16A, since a flat image was formed on the downstream side in Experiment 2, when compared with the case of exemplary embodiment 1, the zone where toner was refilled was shifted to the toner supply position more quickly, and toner was started to be refilled on the second page. In FIGS. 16A, 16B, in Experiment 2, the difference in toner density between the upstream side and the downstream side is suppressed to 1.8% at maximum, and the difference in toner density is not recognized visually even in the halftone image.

In contrast to this, in FIG. 17, in Comparison Example 2, as in Comparison Example 1, since the positions to which toner is supplied and the positions in which toner is consumed are different from each other, the difference in toner density became a maximum of 2.6% on the fourth page as shown in FIG. 17B. When the halftone image is checked, the toner density difference is visually recognized as a left-and-right difference in printing density in the width direction.

Modified Examples

While the exemplary embodiments of the invention have been described in detail above, the invention is not limited to those exemplary embodiments. Various changes and modifications may be made within a spirit and scope of claims. Modified examples (H01) to (H07) of the invention will be illustrated as below.

(H01) While in the exemplary embodiments, the printer is illustrated as the image forming apparatus, the invention is not limited thereto. The invention may be applied to a Fax machine, a copying machine, or a multifunction equipment which has functions of the Fax and copying machines. Also, the invention is not limited to the image forming apparatus in which the multi-color printing is performed. The invention may be applied to an image forming apparatus which is configured to produce for a single color or monochrome image.

(H02) The method for dividing the toner conveyance chambers into the accumulated consumption calculation zones, number of the zones and lengths of the zones are not limited to those described in the exemplary embodiments. They may be changed arbitrarily as designs require.

(H03) While in the exemplary embodiments, the developing unit G and the toner supply container (11+16+18) are configured to be integrated into the single unit which is replaceable as a whole, the invention is not limited thereto. The developing unit and the toner supply container may be configured as separate units, so that the separate units may be connected by a toner conveyance member for conveying toner therebetween.

Figure 18A:
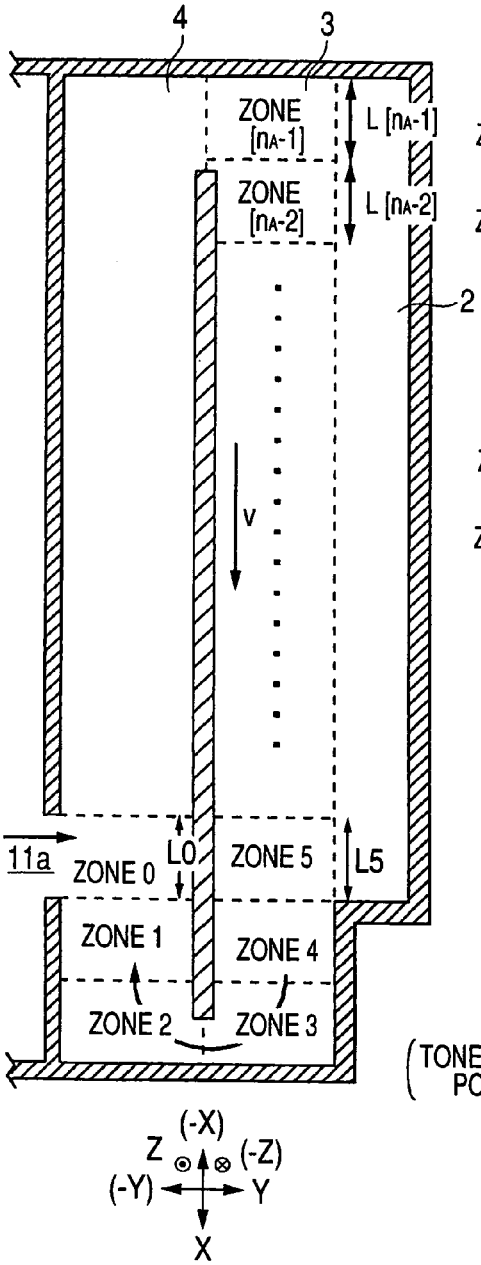
FIG. 18A is an explanatory drawing for the case in which a movement distance of the developer during a unit time t1 is equal to a length of the accumulated consumption calculation zone.
Figure 18B:
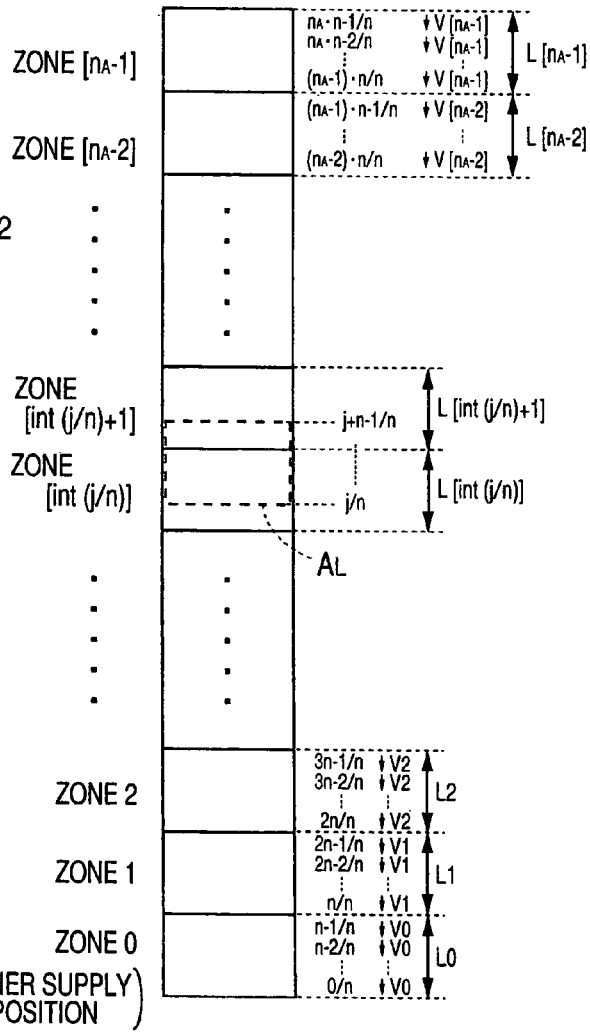
FIG. 18B is an explanatory drawing for the case in which the length of the accumulated consumption calculation zone is integral multiple of the movement distance of the developer during the unit time t1.

FIG. 18 is an explanatory drawing of a modified example, FIG. 18A is an explanatory drawing for the case in which a movement distance of the developer during a unit time t1 is equal to a length of the accumulated consumption calculation zone, and FIG. 18B is an explanatory drawing for the case in which the length of the accumulated consumption calculation zone is integral multiple of the movement distance of the developer during the unit time t1.

(H04) While in the exemplary embodiments, the toner consumption is calculated every time toner is consumed so as to calculate the toner balance, the invention is not limited thereto. Consumptions at respective times may be stored as a history, and an accumulated consumptions in a zone which is moved to the toner supply position may be calculated from the history of consumptions.

In FIG. 18A, it is assumed that $n_A$ denotes a total number of the accumulated consumption calculation zones; that the zones are called a zone 1, a zone 2, a zone 3, . . . a zone $n_A-1$ from the accumulated consumption calculation zone A1 corresponding to the developer supply port 11 toward the upstream side of the developer conveyance direction; that i denotes an integer equal to or larger than 0 and equal to or less than $n_A-1$; that t1 denotes a time interval in which the developer consumption calculator calculates the consumption of the developer in each zone; that ct (i, t) denotes a consumption of the developer in the region i during a time step t, t denotes an integer; that a length of each time step t is equal to the time interval t1; that Li denotes a length of the zone in the developer conveyance direction; that vi denotes a conveyance speed at which the developer in the zone i is conveyed during the time interval t1; and that j is a positive number that is equal to or larger than zero and equal or less than $(n_A-1)$. In this case, if Li=vi×t1, the zone that is moved to the toner supply position passed the zone j at a time (t−j) that is j×t1 before the current time t. Therefore, the accumulated consumption in such a zone can be calculated based on the following formula. Accordingly, the exemplary embodiments may be modified so as to calculate the accumulated consumptions of the developer in the respective accumulated consumption calculation zones based on the following formula (1).

$$\sum_{j=0}^{n_A-1} ct(j, t-j) \tag{1}$$

In the exemplary embodiments 1 and 2 and FIG. 18, the length Li of each accumulated consumption calculation zone is equal to the distance (vi×t1) by which the developer moves during the time t1. However, if Li is integral multiple of (vi×t1) as shown in FIG. 18B, that is, if Li=n×(vi×t1), the accumulated consumptions of the developer can be calculated based on the history of the consumptions of the developer in the respective zones 0 to $(n_A-1)$ in a similar manner.

In FIG. 18B, if L=n×(vi×t1), after the unit time t1 has elapsed, the developer is moved Li×(1/n) to the downstream side where Li denotes the length of each accumulated consumption calculation zone along the developer conveyance direction. Then, when the time 2×t1 has elapsed, the developer is moved Li×(2/n) to the downstream side. Also, when the time j×t1 has elapsed, the developer is moved Li×(j/n). Accordingly, it takes time (nA×n−1)×t1 for a consumption calculation target zone $A_L$ indicated by the dotted lines to move from the zone $n_A-1$ on the most upstream side to the zone the zone 0 corresponding to the toner supply port 11*a*. Then, at a time (t−j) that is j×t1 before the time t, the consumption calculation target zone $A_L$ straddle two zones of the zone 0 to zone $(n_A-1)$, that is, a zone [int(j/n)] and a zone [int(j/n)+1] where int(a) represents a function of ignoring fraction of a value 'a' and returns an integral part of the value 'a'.

Accordingly, when the consumption calculation target zone $A_L$ straddles the zone [int(j/n)] and the zone [int(j/n)+1] in calculating a consumption of the developer in the moving consumption calculation target zone $A_L$, a consumption of the developer in the zone [int(j/n)] at the time (t−j) is regarded as the consumption of the developer in the consumption calculation target zone $A_L$, thereby calculating an accumulated consumption in a zone that is moved to the toner supply zone based on the following formula.

$$\sum_{j=0}^{n_A \times n-1} ct\left(\mathrm{int}\left(\frac{j}{n}\right), t-j\right) \quad (2)$$

Also, when the consumption calculation target zone $A_L$ straddles the zone [int(j/n)] and the zone [int(j/n)+1] in calculating a consumption of the developer in the moving consumption calculation target zone $A_L$, the consumption in the consumption calculation target zone $A_L$ may be calculated based on the consumption in the zone [int(j/n)], the consumption in the zone [int(j/n)+1] and an overlapping ratio of the consumption calculation target zone $A_L$. Specifically, the accumulated consumption in the zone $A_L$, which is moved to the toner supply position, may be calculated based on the following formula (3).

$$\sum_{j=0}^{n_A \times n-1} \sum_{k=0}^{n-1} ct\left(\mathrm{int}\left(\frac{j+k}{n}\right), t-j\right) \Big/ n \quad (3)$$

where k denotes an integer equal to or larger than zero and equal to or less than (n−1), and if $i > n_A - 1$, ct(i, t)=0.

Accordingly, in place of the formula (1), the accumulated consumption may be calculated based on either the formula (2) or (3).

Furthermore, if the printing zone extends from a zone p to a zone q, a zone i (i<p or i>q) is out of the printing zone. Therefore, the developer is not consumed in such a zone i. That is, ct(i, t) is always equal to zero in the zone i(i<p or i>q), a calculation amount can be reduced by excluding ct(i, t) that is always equal to zero. Accordingly, in place of the formula (1), the following formula (4) may be used to calculated the accumulated consumption.

$$\sum_{j=p}^{q} ct(j, t-j) \quad (4)$$

For example, FIG. 18A corresponds to the case where the constants p and q in the formula (4) are equal to 5 and $n_A - 1$, respectively.

(H05) While in the exemplary embodiments, the consumption is calculated based on the number of accumulated pixels written by the latent image formation unit ROS, the invention is not limited thereto. For example, the consumption may be calculated by considering a factor of an image structure as to whether it is made up of isolated pixels or pixels which are continuously painted or taking environment and aging into consideration. On the contrary, a supply amount may be set not by calculating the toner consumption but by regarding the number of accumulated pixels itself as the consumption. In addition, other characteristic values which represent indirectly the toner consumption such as amounts of toner present in the respective zones may also be used in place of the toner balance.

(H06) In the exemplary embodiments, the toner consumption is calculated on the assumption that the developer in the respective accumulated consumption calculation zones is conveyed toward the downstream side. However, in reality, the toner is agitated when conveyed by the circulation conveyance members 7, 8, whereby the toner is diffused from the zone where the toner density is high to the zone where the toner density is low. Therefore, it is possible to take the diffusion of toner into consideration when the consumption is shifted. For example, the consumption in a certain zone may be compared with the consumption in a neighboring zone. If any difference therebetween, it is possible to perform such a process that the toner in the zone whose consumption is less is reduced according to the diffusion coefficient, whereas the toner in the zone whose consumption is more is increased.

(H07) In the exemplary embodiments, the two-component developer made up of toner and carrier is accommodated in the developer accommodation chambers (2 to 4) and toner is accommodated in the toner supply container (11+16+18). However, the invention is not limited thereto. For example, such a configuration may be adopted that a minute amount of carrier is mixed into toner to be supplied or that the deteriorated developer is discharged little by little, while a toner of high density which contains high-density toner and carrier is supplied.

What is claimed is:

1. A developing unit comprising:

a developer carrying body accommodated in a developer-carrying-body accommodation chamber, the developer carrying body that holds a developer on a surface thereof to convey the developer to a developing zone where a latent image is developed into a visualized image;

a circulation conveyance chamber comprising a first agitating conveyance chamber disposed to be adjacent to the developer-carrying-body accommodation chamber, the first agitating conveyance chamber that accommodates therein a two-component developer, and a second agitating conveyance chamber disposed to be adjacent to the first agitating conveyance chamber, the second agitating conveyance chamber that includes an inlet portion through which the developer flows in from the first agitating conveyance chamber, and an outlet portion through which the developer flows out to the first agitating conveyance chamber, in the circulation conveyance chamber, the developer being conveyed in a circulating fashion;

a circulation conveyance member comprising a first developer conveyance member accommodated in the first agitating conveyance chamber, the first developer conveyance member that conveys the developer in the first agitating conveyance chamber in a first conveyance direction, and a second developer conveyance member accommodated in the second agitating conveyance chamber, the second developer conveyance member that conveys the developer in the second agitating conveyance chamber in a second conveyance direction opposite to the first conveyance direction, the circulation conveyance member that conveys the developer in the circulation conveyance chamber in a circulating fashion; and a developer supply portion provided in a developer supply position of the circulation conveyance chamber;

at least a part of the circulation conveyance chamber is divided into a plurality of zones each having a predetermined range, a consumption calculator that calculates a consumption of the developer in each zone, and the developer supply portion supplies a developer based on the calculated consumption of each zone after developing, an accumulated consumption of developer in each zone is calculated while each zone is moving in the circulation conveyance chamber as the circulation conveyance member conveys the developer, and when each zone reaches the developer supply position, a developer that is equal to in amount to the accumulated consumption of developer in each zone is supplied to each zone.

2. The developing unit according to claim 1, wherein the developer consumption calculator calculates the accumulated consumption of developer in each zone while each zone is moving in the circulation conveyance chamber as the circulation conveyance member conveys the developer, the developer consumption calculator calculates the accumulated consumption using the following formula:

$$\sum_{j=0}^{n_A \times n-1} \sum_{k=0}^{n-1} ct\left(\mathrm{int}\left(\frac{j+k}{n}\right), t-j\right) \Big/ n$$

where $n_A$ denotes a total number of the plurality of zones each having the predetermined range, the plurality of zones are called a zone 1, a zone 2, a zone 3, . . . a zone $n_A-1$ from the zone corresponding to the developer supply portion toward an upstream side of the first conveyance direction, i denotes an integer equal to or larger than 0 and equal to or less than $n_A-1$, t1 denotes a time interval in which the developer consumption calculator calculates the accumulated consumption of developer in each zone, vi denotes a conveyance speed at which either the first or second developer conveyance member conveys the developer in the zone i during the time interval t1, Li denotes a length of each first zone in the first conveyance direction, Li/vi=an integer n, j and k denote integers, int((j+k)/n) denotes a function that ignores fraction of (j+k)/n and returns an integer part of (j+k)/n, ct(i, t) denotes a consumption of the developer in the region i during a time step t, t denotes an integer, and a length of each time step t is equal to the time interval t1.

3. An image forming apparatus comprising:

an image carrying body that holds a latent image on a surface thereof;

the developing unit according to claim 1, which develops the latent image held on the surface of the image carrying body into a visualized image; and a transfer unit that transfers the visualized image formed on the image carrying body to a medium.

4. A visualized image formation unit comprising:

an image carrying body that holds a latent image on a surface thereof; and the developing unit according to claim 1, which develops the latent image held on the surface of the image carrying body into a visualized image.

5. A developing unit comprising:

a developer carrying body accommodated in a developer-carrying-body accommodation chamber, the developer carrying body that holds a developer on a surface thereof to convey the developer to a developing zone where a latent image is developed into a visualized image;

a circulation conveyance chamber comprising a first agitating conveyance chamber disposed to be adjacent to the developer-carrying-body accommodation chamber, the first agitating conveyance chamber that accommodates therein a two-component developer, and a second agitating conveyance chamber disposed to be adjacent to the first agitating conveyance chamber, the second agitating conveyance chamber that includes an inlet portion through which the developer flows in from the first agitating conveyance chamber, and an outlet portion through which the developer flows out to the first agitating conveyance chamber, in the circulation conveyance chamber, the developer being conveyed in a circulating fashion;

a circulation conveyance member comprising a first developer conveyance member accommodated in the first agitating conveyance chamber, the first developer conveyance member that conveys the developer in the first agitating conveyance chamber in a first conveyance direction, and a second developer conveyance member accommodated in the second agitating conveyance chamber, the second developer conveyance member that conveys the developer in the second agitating conveyance chamber in a second conveyance direction opposite to the first conveyance direction, the circulation conveyance member that conveys the developer in the circulation conveyance chamber in a circulating fashion;

a developer supply portion provided in a developer supply position of the circulation conveyance chamber;

a developer consumption calculator that calculates consumptions of developer in respective zones and stores the calculated consumption in each zone into a corresponding storage region, wherein at least a part of the circulation conveyance chamber is divided into the plurality of zones each having a predetermined range along the first conveyance direction and the second conveyance direction;

a consumption shift unit that shifts the consumption stored in the storage region corresponding to each zone to a storage region corresponding to a zone located on a downstream side of each zone in the developer conveyance direction, in response to the conveying of the developer by the circulation conveyance member;

a supply amount setting unit that sets a supply amount from the developer supply portion based on the consumption stored in the storage region corresponding to the zone that corresponds to the developer supply position; and a developer supply controller that controls supply of the developer from the developer supply portion based on the set supply amount by consumption of the developer after developing.

6. The developing unit according to claim 5, wherein the developer consumption calculator subtracts the supply amount from the consumption stored in the storage region corresponding to the zone in the developer supply position when the developer is supplied in the developer supply position.

7. The developing unit according to claim 6, wherein:

a developer balance in each zone is obtained by subtracting the consumption stored in the storage region corresponding to each zone from the supply amount therein, and the developer supply controller permits a supply operation from the developer supply portion when a total sum of the developer balances in all the respective zones takes a negative value.

8. The developing unit according to claim 6, wherein:

a developer balance in each zone is obtained by subtracting the consumption therein from the supply amount therein, and the developer supply controller stops a supply operation from the developer supply portion when a total sum of the developer balances in all the respective zones takes a positive value.

9. The developing unit according to claim 6, wherein a length of each zone in the first conveyance direction is set to be proportional to a conveyance speed at which the corresponding first or second conveyance member conveys the developer in each zone.

10. The developing unit according to claim 9, wherein the following formula is satisfied in each zone:

$$t1=\text{integer}\times L/v$$

wherein t1 denotes a time interval in which the developer consumption calculator calculates the consumption of the developer in each zone, L denotes a length of the zone in the developer conveyance direction, and v denotes a conveyance speed at which the developer is conveyed during the time interval.

11. The developing unit according to claim 5, wherein the developer consumption calculator calculates the consumption in each zone based on number of accumulated pixels of an image which corresponds to each zone.

12. An image forming apparatus comprising:

an image carrying body that holds a latent image on a surface thereof;

the developing unit according to claim 5, which develops the latent image held on the surface of the image carrying body into a visualized image; and a transfer unit that transfers the visualized image formed on the image carrying body to a medium.

13. A visualized image formation unit comprising:

an image carrying body that holds a latent image on a surface thereof; and the developing unit according to claim 5, which develops the latent image held on the surface of the image carrying body into a visualized image.

* * * * *